US009568880B2

(12) United States Patent
Yamazaki et al.

(10) Patent No.: US 9,568,880 B2
(45) Date of Patent: Feb. 14, 2017

(54) SHEET PROCESSING APPARATUS AND IMAGE FORMING APPARATUS HAVING BINDING PROCESSING FUNCTION

(71) Applicant: CANON KABUSHIKI KAISHA, Tokyo (JP)

(72) Inventors: Yoshitaka Yamazaki, Abiko (JP); Hiroshi Saito, Kashiwa (JP); Tetsuro Fukusaka, Abiko (JP); Shigemi Kumagai, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 101 days.

(21) Appl. No.: 14/602,230

(22) Filed: Jan. 21, 2015

(65) Prior Publication Data

US 2015/0203310 A1 Jul. 23, 2015

(30) Foreign Application Priority Data

| | | |
|---|---|---|
| Jan. 23, 2014 | (JP) | 2014-010447 |
| Jan. 23, 2014 | (JP) | 2014-010448 |
| Jan. 9, 2015 | (JP) | 2015-003137 |
| Jan. 9, 2015 | (JP) | 2015-003138 |

(51) Int. Cl.
*B65H 37/04* (2006.01)
*G03G 15/00* (2006.01)
(Continued)

(52) U.S. Cl.
CPC ..... *G03G 15/6544* (2013.01); *B31F 5/02* (2013.01); *B42C 1/00* (2013.01); *B42F 3/003* (2013.01); *B65H 37/04* (2013.01); *G03G 15/5004* (2013.01); *B31F 2201/0712* (2013.01); *B31F 2201/0779* (2013.01); *B65H 2301/43828* (2013.01); *B65H 2301/51616* (2013.01); *B65H 2801/27* (2013.01); *G03G 2215/00852* (2013.01)

(58) Field of Classification Search
CPC ..... B31F 5/02; B31F 2201/0712; B31F 2201/0779; B65H 2301/51616; B42F 3/003; G03G 2215/00852
USPC ..... 270/58.07, 58.08, 58.09
See application file for complete search history.

(56) References Cited

U.S. PATENT DOCUMENTS 5,573,233 A * 11/1996 Hirai et al. ..... 270/58.08
7,240,898 B2 * 7/2007 Takamura et al. ..... 270/58.09
(Continued)

FOREIGN PATENT DOCUMENTS

| | | |
|---|---|---|
| JP | 2004155537 A | 6/2004 |
| JP | 2005206374 A | 8/2005 |
| JP | 2013123817 A | 6/2013 |

*Primary Examiner* — Leslie A Nicholson, III
(74) *Attorney, Agent, or Firm* — Canon USA, Inc. IP Division

(57) ABSTRACT

A sheet processing apparatus includes a binding unit configured to perform binding processing by pressing a sheet bundle, a motor configured to drive the binding unit to press the sheet bundle, and a motor control unit configured to set a driving current of the motor and an upper limit value of the driving current, the motor control unit being configured to set the driving current when starting activating the motor in a state where the binding unit is not pressing the sheet bundle to a first value, and set the upper limit value of the driving current in a period in which the binding unit is pressing the sheet bundle to a second value less than or equal to the first value.

25 Claims, 12 Drawing Sheets

(51) Int. Cl.

| | |
|---|---|
| ***B42F 3/00*** | (2006.01) |
| ***B31F 5/02*** | (2006.01) |
| ***B42C 1/00*** | (2006.01) |

(56) References Cited

U.S. PATENT DOCUMENTS

| | | | | |
|---|---|---|---|---|
| 7,404,550 | B2 * | 7/2008 | Vogel et al. | 270/52.18 |
| 8,342,499 | B2 * | 1/2013 | Shiraishi et al. | 270/58.08 |

* cited by examiner

SHEET PROCESSING APPARATUS AND IMAGE FORMING APPARATUS HAVING BINDING PROCESSING FUNCTION

BACKGROUND

Field

Aspects of the present invention generally relate to a sheet processing apparatus and an image forming apparatus having a binding processing function.

Description of the Related Art

A stapling device has conventionally been used widely as a device for binding sheets on which images are formed by an image forming apparatus such as a copying machine and a printer. The stapling device performs binding processing to bind a sheet bundle including a plurality of sheets by using a binding member such as metal staples. However, when using each sheet of the sheet bundle stapled by the stapling device as a document to be read, the staples binding the sheet bundle need to be removed. When recycling the sheet bundle bound by staples, the staples binding the sheet bundle also need to be removed to separately collect the sheets and the staples from the viewpoint of environmental protection. Since the staples used for the binding processing are discarded after being used, there has been a problem in terms of reuse of resources.

Japanese Patent Application Laid-Open No. 2004-155537 discusses a sheet binding device that uses no binding member such as a staple to reduce time and effort when reusing the sheets as a document or at the time of recycling. Using no staples, such a sheet binding device discards no staples. The sheet binding device is configured to, after a plurality of sheets conveyed from an image forming apparatus is bundled and aligned into a sheet bundle, press against sheets a tooth die having protrusions and recesses for forming recesses and protrusions in part of the sheet bundle. The sheet binding device performs binding processing by thus pressing the sheet bundle to entangle fibers of the sheet bundle with each other.

In a case where the conventional stapleless binding method described above is applied to an image forming apparatus, it is conceivable that an actuator is used as a driving source for pressing the tooth die having protrusions and recesses against the sheet bundle to automate the pressing operation. In the stapleless binding processing, steady application of constant pressing force to the sheet bundle is important in maintaining the quality of the sheet bundle after undergoing the binding processing so that the retention force of the binding portion lasts and the bound portion will not get broken. In order for the actuator to provide constant pressing force, the output torque of the actuator can be controlled by controlling the driving current value received by the actuator to be a predetermined value. The predetermined value is selected to be smaller than a value of the driving current corresponding to maximum output torque that the actuator can output. The reason is that the pressing force needed for the binding processing has a predetermined range that differs depending on the number and a type of sheets of the sheet bundle.

If the pressing force needed to be applied to the sheet bundle is low, the actuator is controlled by a driving current value lower than usual throughout the binding processing operation. In such a case, the output torque that the actuator can produce at start-up is also limited to a low value similar to the binding processing operation. This increases the time needed for the start-up of the actuator and increases the time of the entire binding processing operation. Accordingly, since the time needed for the stapleless binding operation increases, there is a problem that the mounted sheet processing apparatus and/or the overall productivity of image forming apparatus decreases.

The thickness of the sheet bundle and the density of sheets vary according to the number of sheets and paper type of the sheet bundle. As a result, the timing at which constant pressing force is applied to the sheet bundle varies. If the period of application of the constant pressing force to the sheet bundle is not properly adjusted, a phenomenon in which the sheet bundle exfoliates easily (hereinafter, referred to as poor binding) can occur. Application of excessive pressure to the sheet bundle can break the sheets.

SUMMARY

Aspects of the present invention are generally directed to a sheet processing apparatus and an image forming apparatus that can improve the quality and productivity of stapleless binding processing.

According to an aspect of the present invention, there is provided a sheet processing apparatus including a binding unit configured to perform binding processing by pressing a sheet bundle, a motor configured to drive the binding unit to press the sheet bundle, and a motor control unit configured to set a driving current of the motor and an upper limit value of the driving current. The motor control unit is configured to set the driving current when starting activating the motor in a state where the binding unit is not pressing the sheet bundle at a first value, and set the upper limit value of the driving current in a period in which the binding unit is pressing the sheet bundle at a second value less than or equal to the first value.

Further features of the present disclosure will become apparent from the following description of exemplary embodiments with reference to the attached drawings.

DESCRIPTION OF THE EMBODIMENTS

Figure 1A:
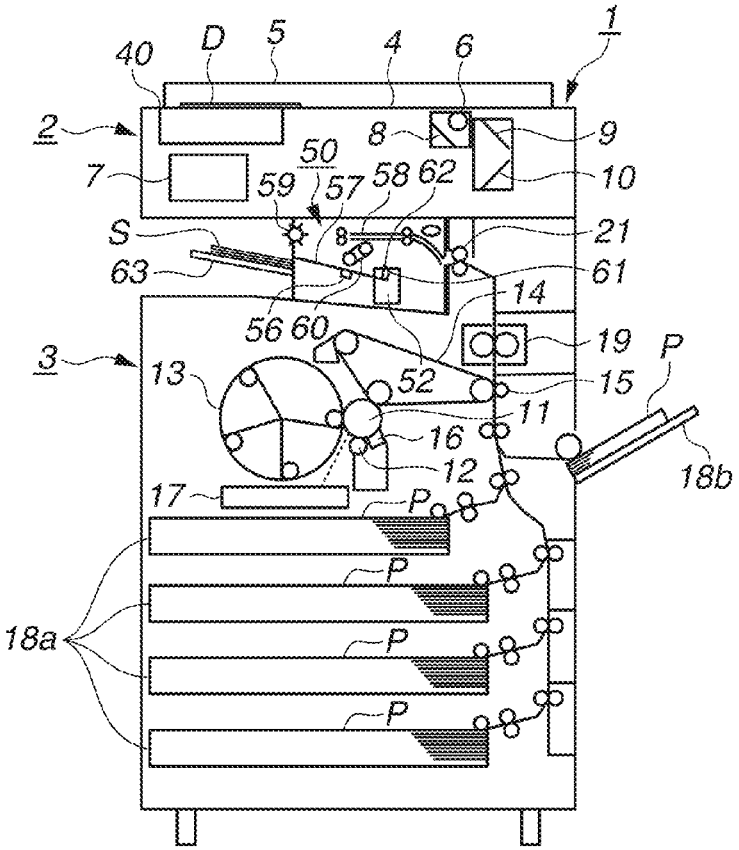
FIGS. 1A and 1B are diagrams illustrating a configuration of an image forming apparatus and a sheet processing apparatus.

Exemplary embodiments will be described in detail below with reference to the drawing.

(Image Forming Apparatus)

A first exemplary embodiment will be described below. FIG. 1A is a schematic cross-sectional view of an image forming apparatus and a sheet processing apparatus serving as an image forming system according to the exemplary embodiment. FIG. 1A illustrates the image forming apparatus 1 in which its front (front face) is situated on the near side. The image forming apparatus 1 includes an image reading unit 2, an image forming unit 3, and a sheet processing apparatus 50. A user sets a job into the image forming apparatus 1 from an operation unit or from an external apparatus such as a personal computer (PC) via a network. If the set job is a copy operation, the image forming apparatus 1 performs image forming processing and post-processing of the sheet based on image data from the image reading unit 2. If the set job is a print operation, the image forming apparatus 1 performs image forming processing and post-processing of the sheet based on image data transmitted from the PC via the network.

The image reading unit 2 will be described. A platen 4 including a transparent glass plate is fixed on an upper part of the image reading unit 2. A document D is placed on a predetermined position of the platen 4 with an image side down. The document D is pressed and seated by a platen cover 5. An optical system including a lamp 6 for illuminating the document D and reflection mirrors 8, 9, and 10 for guiding an optical image of the illuminated document D to an image processing unit 7 is arranged under the platen 4. The image processing unit 7 includes an image sensor. The lamp 6 and the reflection mirrors 8, 9, and 10 move at a predetermined speed to scan the document D and transmit image data to the image forming unit 3.

The image forming unit 3 includes a photosensitive drum 11, a primary charging roller 12, a rotary developing unit 13, an intermediate transfer belt 14, a transfer roller 15, and a cleaner 16. The photosensitive drum 11 is irradiated with laser light from a laser unit 17 based on image data, whereby an electrostatic latent image is formed on the surface of the photosensitive drum 11. The primary charging roller 12 uniformly charges the surface of the photosensitive drum 11 before the laser light irradiation. The rotary developing unit 13 makes magenta (M), cyan (C), yellow (Y), and black (K) color toners adhere to the electrostatic latent image formed on the surface of the photosensitive drum 11, thereby forming a toner image. When specifying color, the symbols M, C, Y, and K will be attached to reference numerals. The toner image developed on the surface of the photosensitive drum 11 is transferred to the intermediate transfer belt 14, and the toner image on the intermediate transfer belt 14 is transferred to a sheet P in a transfer position by the transfer roller 15. The cleaner 16 removes toners remaining on the photosensitive drum 11 after the transfer of the toner image.

The toner image developed on the photosensitive drum 11 by the rotary developing unit 13 is transferred to the intermediate transfer belt 14. The toner image on the photosensitive belt 14 is transferred to the sheet P by the transfer roller 15. The sheet P is supplied from a sheet cassette 18*a*. The sheet P may be supplied from a manual feed tray 18*b*. A fixing unit 19 is arranged on a downstream side of the image forming unit 3 in a conveyance direction of the sheet P (hereinafter, simply referred to as a downstream side). The fixing unit 19 performs fixing processing on the toner image on the conveyed sheet P. The sheet P on which the toner image is fixed by the fixing unit 19 is discharged from the image forming apparatus 1 to the sheet processing apparatus 50 on the downstream side by a discharge roller pair 21. The portion where the sheet P is discharged by the discharge roller pair 21 will be referred to as a sheet discharge section.

(Sheet Processing Apparatus)

Figure 1B:
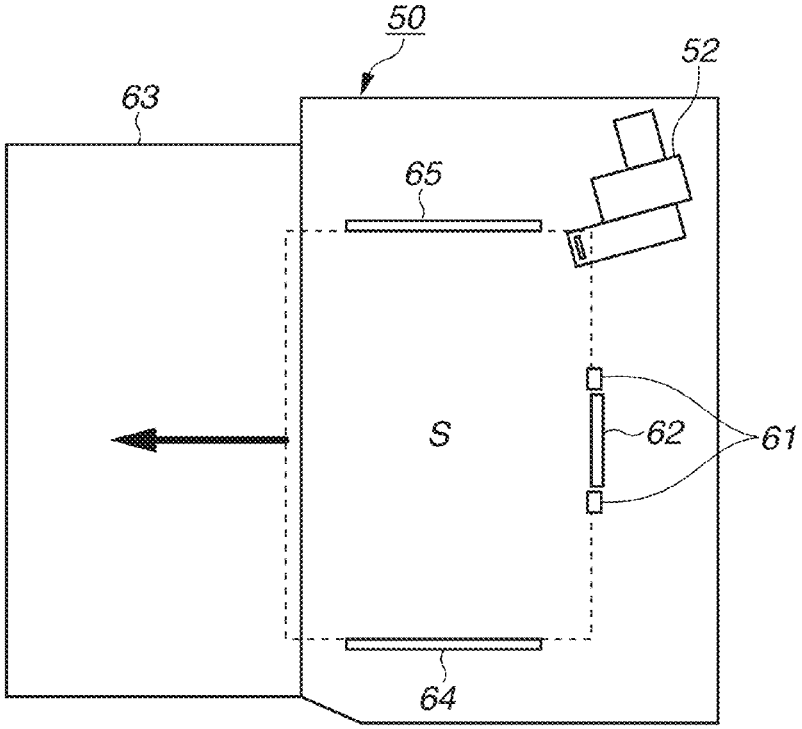

Next, the sheet processing apparatus 50 will be described. As illustrated in FIG. 1A, the sheet processing apparatus 50 is arranged in the sheet discharge section of the image forming apparatus 1. The sheet processing apparatus 50 communicates with the image forming apparatus via a not-illustrated signal line to operate in cooperation with the image forming apparatus 1. FIG. 1B is a view of the sheet processing apparatus 50 from above, with the image reading unit 2 detached. Some of the members illustrated in FIG. 1A are omitted in FIG. 1B. The bottom side of FIG. 1B corresponds to the front side (near side) of the image forming apparatus 1 illustrated in FIG. 1A. In FIG. 1B, a thick black arrow indicates the conveyance direction of a sheet bundle S illustrated in broken lines after binding processing.

The sheet processing apparatus 50 includes a stapleless binding device 52 which bundles a plurality of sheets P discharged from the image forming apparatus 1 into a sheet bundle S and performs binding processing by entangling fibers of the sheet bundle S with each other without using a binding member such as a staple. The stapleless binding device 52 includes tooth dies (upper teeth 97 and lower teeth 98; see FIG. 2) having protrusions and recesses arranged to be opposed to each other for forming embossed protrusions and recesses in part of the sheet bundle S. The stapleless binding device 52 bundles and aligns a plurality of sheets P conveyed from the image forming apparatus 1 into a sheet bundle S, and then sandwiches the sheet bundle S inserted between the tooth dies having the protrusions and recesses. The stapleless binding device 52 then performs binding processing by pressing the tooth dies against the sheet bundle S sandwiched between the tooth dies having the protrusions and recesses to entangle the fibers of the sheet bundle S with each other. Hereinafter, the binding processing for performing binding by entangling the fibers of the sheet bundle S with each other without using a binding member such as a staple will be referred to as "stapleless binding" processing.

After a sheet P discharged from the image forming apparatus 1 is received by a conveyance unit 58, the sheet processing apparatus 50 performs accelerated conveyance in which the conveyance speed of the sheet P is accelerated from the speed within the image forming apparatus 1. After the conveyance of the sheet P from the conveyance unit 58, the sheet processing apparatus 50 drives a paddle roller 59 to rotate, whereby the sheet P is stacked on a processing tray 57. The sheet processing apparatus 50 further performs trailing edge alignment processing in which a return roller 60 makes the trailing edge of the sheet P abut on a trailing edge alignment plate 62, whereby the trailing edges of the stacked sheets P are aligned.

A sheet sensor 56 is a sensor that detects the presence and absence of sheets P on the processing tray 57. The sheet bundle S including the plurality of sheets P having undergone the trailing edge alignment processing in the processing tray 57 is aligned in a sheet width direction by alignment plates 64 and 65 and stacked on the processing tray 57. The sheet width direction refers to a direction orthogonal to the conveyance direction of the sheets P. The sheet processing apparatus 50 repeats this series of operations. If the stapleless binding processing is specified in a job, a specified number of sheets P are stacked on the processing tray 57 and then the stapleless binding device 52 performs the binding processing on the position illustrated in FIG. 1B. More specifically, the stapleless binding device 52 performs the binding processing on either one of the rear corners of the sheet bundle S. The position for performing the stapleless binding processing is not limited to the position illustrated in FIG. 1B. After the completion of the binding processing by the stapleless binding device 52, the sheet bundle S is discharged to a discharge tray 63 along the bottom surface of the processing tray 57 such that the trailing edge side of the sheet bundle S is pushed out by bundle pressing members 61.

(Stapleless Binding Device)

Figure 2A:
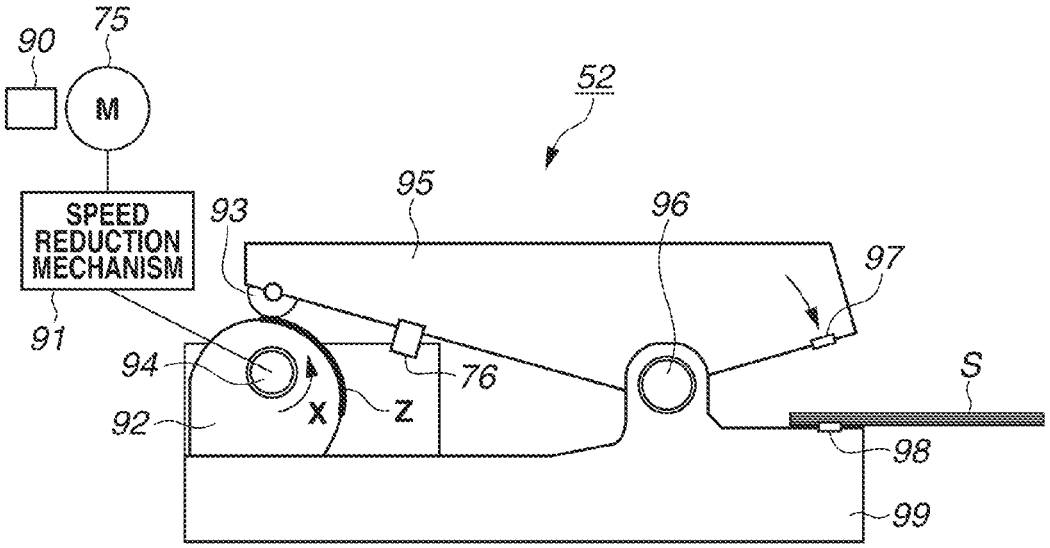
FIGS. 2A and 2B are diagrams illustrating a configuration of a stapleless binding device.
Figure 2B:
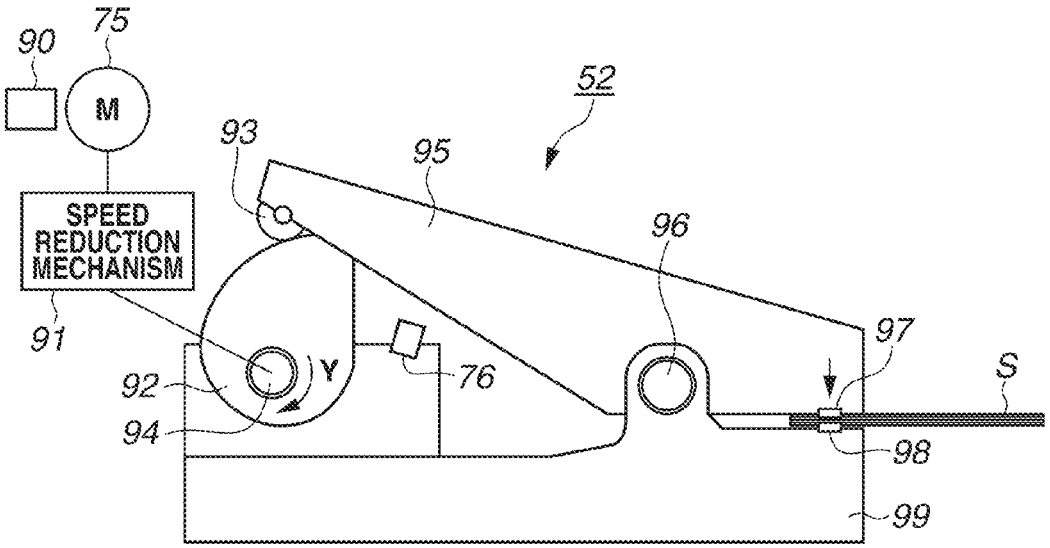

A detailed configuration of the stapleless binding device 52 will be described with reference to FIGS. 2A and 2B. FIG. 2A illustrates a waiting state where the stapleless binding device 52 is not performing a binding operation. FIG. 2B illustrates a binding state. In the stapleless binding device 52, an output shaft of a stapleless binding motor 75 (hereinafter, referred to simply as a motor; in FIGS. 2A and 2B, denoted as M) is connected to a cam rotation shaft 94 via a speed reduction mechanism 91 including a gear. In the present exemplary embodiment, the motor 75 is a direct-current (DC) brush motor. An encoder sensor 90 serving as a speed detection unit for measuring rotation speed, that is the number of rotations per unit time, is arranged on the output shaft of the motor 75. The encoder sensor 90 is an optical sensor. The encoder sensor 90 detects slits formed in a disk on the output shaft of the motor 75, and outputs a pulse signal whose period varies with the rotation speed of the motor 75. A central processing unit (CPU) 162 to be described below (see FIG. 3) can detect the rotation speed of the motor 75 based on the pulse signal input from the encoder sensor 90. In the present exemplary embodiment, the disk arranged on the output shaft of the motor 75 is configured to have 18 slits in circumference.

According to the rotation of the cam rotation shaft 94, a cam 92 actuates an upper arm 95 via a roller 93. The upper teeth 97 serving as a first pressing unit for pressing one surface of the sheet bundle S are attached to the upper arm 95. The upper arm 95 swings about an arm shaft 96. A lower arm 99 is fixed to a casing frame of the sheet processing apparatus 50. The lower teeth 98 serving as a second pressing member for pressing the other surface of the sheet bundle S are attached to the lower arm 99. The lower teeth 98 are arranged to be opposed to the upper teeth 97. The protrusions and recesses of the tooth dies described above correspond to the upper teeth 97 and the lower teeth 98. Whichever may correspond to the protrusions or recesses. In the present exemplary embodiment, the lower arm 99 is configured to be fixed to the casing frame of the sheet processing apparatus 50. However, the upper arm 95 may be configured to be fixed to the casing frame. Both the upper arm 95 and the lower arm 99 may be configured not to be fixed to the casing frame.

The lower teeth 98 attached to the lower arm 99 and the upper teeth 97 attached to the upper arm 95 sandwich the sheet bundle S and mesh with each other to press the sheet bundle S. The surface of each sheet P of the pressed sheet bundle S is stretched by the upper and lower teeth 97 and 98 meshing with each other, to expose fibers. As the sheet bundle S is further pressed by the upper teeth 97 and the lower teeth 98, the fibers of the sheets P entangle with each other to fasten the sheet bundle S. In such a manner, the sheet bundle S can be fastened without using a binding member such as a staple.

When the sheet S is stacked on the processing tray 57, the cam 92 is in the position illustrated in FIG. 2A. Such a position will be referred to as a bottom dead center of the cam 92. If the cam 92 is positioned at the bottom dead center, a reference sensor 76 detects the upper arm 95. The reference sensor 76 outputs an ON signal to the CPU 162 when the upper arm 95 is detected. In other words, the state illustrated in FIG. 2A where the cam 92 is at the bottom dead center is a state (initial state) before a start of driving by the motor 75. As illustrated in FIG. 2A, when the cam 92 is positioned at the bottom dead center, there is a gap between the upper teeth 97 and the lower teeth 98, and the sheet bundle S can enter the gap. The cam 92 has a droplet shape, for example. While the roller is in contact with a Z portion (thick line portion) illustrated in FIG. 2, a load acting on the motor 75 is negligibly small even if the motor 75 is driving the cam 92. The cam 92 may be shaped so that no load is imposed on the motor 75 while the roller 93 is in contact with the Z portion. The Z portion is an area along a predetermined ridge line distance (thick line portion in FIG. 2A) on the outer periphery of the cam 92 from the bottom dead center of the cam 92. When the motor 75 starts to drive the cam 92, the cam rotation shaft 94 rotates in an X direction (counterclockwise). Together with the rotation of the cam 92, the upper arm 95 starts to move and the reference sensor 76 no longer stops detecting the upper arm 95. The load acting on the motor 75 is negligible as long as the roller 93 is in contact with the Z portion. In the period when the roller 93 is in contact with the Z portion, the upper teeth 97 do not press the sheet bundle S. The Z portion of the cam 92 is thus shaped to make the load on the motor 75 extremely small. Via the speed reduction mechanism 91, the torque of the motor 75 is placed under a substantially zero load.

The stapleless binding device 52 starts a binding operation, and the cam 92 is further rotated in the X direction about the cam rotation shaft 92 by the driving of the motor 75. If the cam rotation shaft 94 of the cam 92 thus continues rotating in the X direction, the contact portion between the roller 93 and the cam 92 separates from the area of the Z portion and the load acting on the motor 75 increases. The upper teeth 97 and the lower teeth 98 mesh with each other in the positional relationship illustrated in FIG. 2B. When the cam 92 is in the position of FIG. 2B, its position is referred to as a top dead center. A driving current of the motor 75 here is adjusted to control the pressure occurring between the upper teeth 97 and the lower teeth 98 such that the upper teeth 97 and the lower teeth 98 mesh at a predetermined pressure. The motor 75 is then reversely rotated in a Y direction (clockwise) about the cam rotation shaft 94. When the cam 92 reaches the bottom dead center illustrated in FIG. 2A again, the reference sensor 76 detects the upper arm 95. If the reference sensor 76 detects the upper arm 95, the CPU 162 to be described below stops driving the motor 75 and the cam 92 stops rotating.

(Control Blocks of Image Forming Apparatus and Sheet Processing Apparatus)

Figure 3:
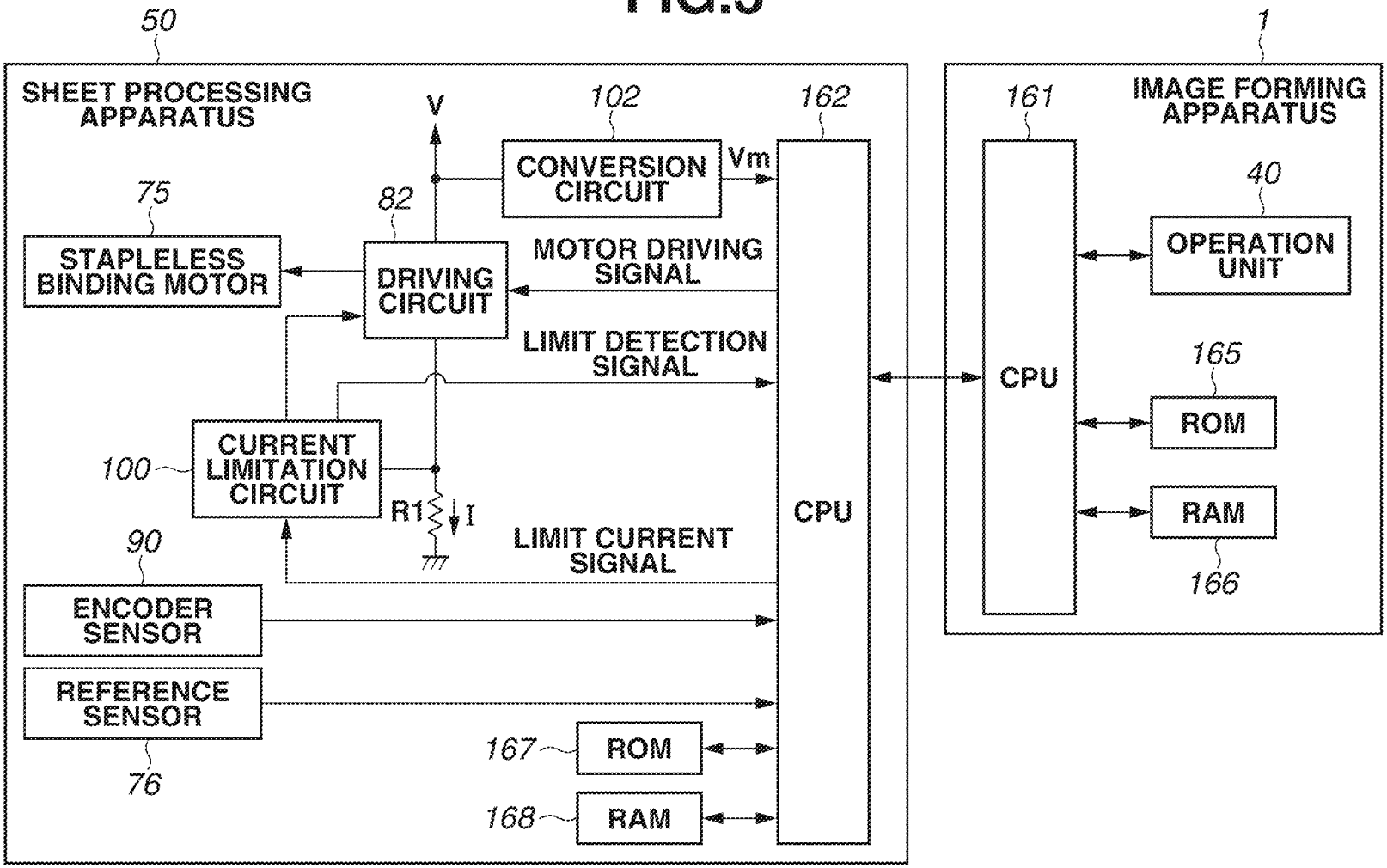
FIG. 3 is a block diagram of the image forming apparatus and the sheet processing apparatus.

Next, control blocks of the image forming apparatus 1 including the sheet processing apparatus 50 illustrated in FIG. 1A will be described with reference to FIG. 3. The image forming apparatus 1 includes a CPU 161, a read-only memory (ROM) 165, a random access memory (RAM) 166, and the operation unit 40. The CPU 161 controls the image forming apparatus 1. The ROM 165 stores a program and data for controlling the image forming apparatus 1. The RAM 166 is used to read and write processing data when the CPU 161 controls the image forming apparatus 1. The operation unit 40 accepts from the user the settings of a post-processing method to be carried out in the image forming apparatus 1 and the sheet processing apparatus 50. In the present exemplary embodiment, the execution of the stapleless binding processing can be selected as a post-processing method. The CPU 161 can communicate with the operation unit 40 to recognize information set by the user operating the operation unit 40 (also referred to as setting information). The sheet processing apparatus 50 includes the CPU 162, a ROM 167, and a RAM 168. The CPU 162 is a control unit that controls the sheet processing apparatus 50. The CPU 162 can communicate with the CPU 161 in the image forming apparatus 1 to detect the states of each other. The ROM 167 stores a program and data for controlling the sheet processing apparatus 50. The RAM 168 is used to read and write processing data when the CPU 162 controls the sheet processing apparatus 50.

The motor 75, the encoder sensor 90, and the reference sensor 76 are included in the stapleless binding device 50 (see FIGS. 2A and 2B). When the upper arm 95 is in the position for accepting the sheet bundle S (the state of FIG. 2A), the reference sensor 76 detects the position as a reference position. The reference sensor 76 then transmits the CPU 162 of the detection of the upper arm 95. The CPU 162 detects whether the upper arm 95 is in the reference position by using the reference sensor 76. The CPU 162 outputs a motor driving signal to a driving circuit 82. The CPU 162 thereby controls driving/stopping of the motor 75 via the driving circuit 82 to perform the binding processing of the stapleless binding device 52. When controlling the driving of the motor 75, the CPU 162 can specify a rotation direction of the motor 75. A driving voltage V is input to the driving circuit 82 and used as a power source for driving the motor 75. A voltage level of the driving voltage V is converted by a conversion circuit 102 and then input to the CPU 162 as a voltage Vm. The CPU 162 detects the voltage level of the driving voltage V from the input voltage Vm. In other words, the CPU 162 also functions as a voltage detection unit. A shunt resistor R1 is inserted between the driving circuit 82 and the ground, and used to detect a driving current I of the motor 75.

A current limitation circuit 100 includes a comparator, and compares a limit current signal input from the CPU 162 with a voltage according to the current flowing through the shunt resistor R1. The current flowing through the shunt resistor R1 is the driving current I of the motor 75. The limit current signal input from the CPU 162 is an analog variable voltage signal. The limit current signal is a signal which maintains the driving current I of the motor 75 at a predetermined value for a predetermined time. The predetermined time refers to time needed to mutually fasten the sheets of the sheet bundle S pressed by the upper teeth 97 and the lower teeth 98. The current limitation circuit 100 compares the voltage signal from the shunt resistor R1 with the limit current signal, and controls the driving circuit 82 so that the driving current I of the motor 75 becomes the predetermined value according to the limit current signal. The current limitation circuit 100 can thus be said to function as a current control unit. The current limitation circuit 100 outputs a limit signal to the CPU 162 when the driving current I of the motor 75 reaches the predetermined value (current value) according to the limit current signal (voltage signal). In other words, the current limitation circuit 100 functions as a current detection unit.

When the motor 75 is driven, the encoder sensor 90 inputs a pulse signal having a frequency proportional to the rotation speed of the motor 75, to the CPU 162. The CPU 162 calculates the rotation speed of the motor 75 by measuring edge intervals of the pulse signal input from the encoder sensor 90 by using a not-illustrated timer.

(Processing on Image Forming Apparatus Side)

Figure 4A:
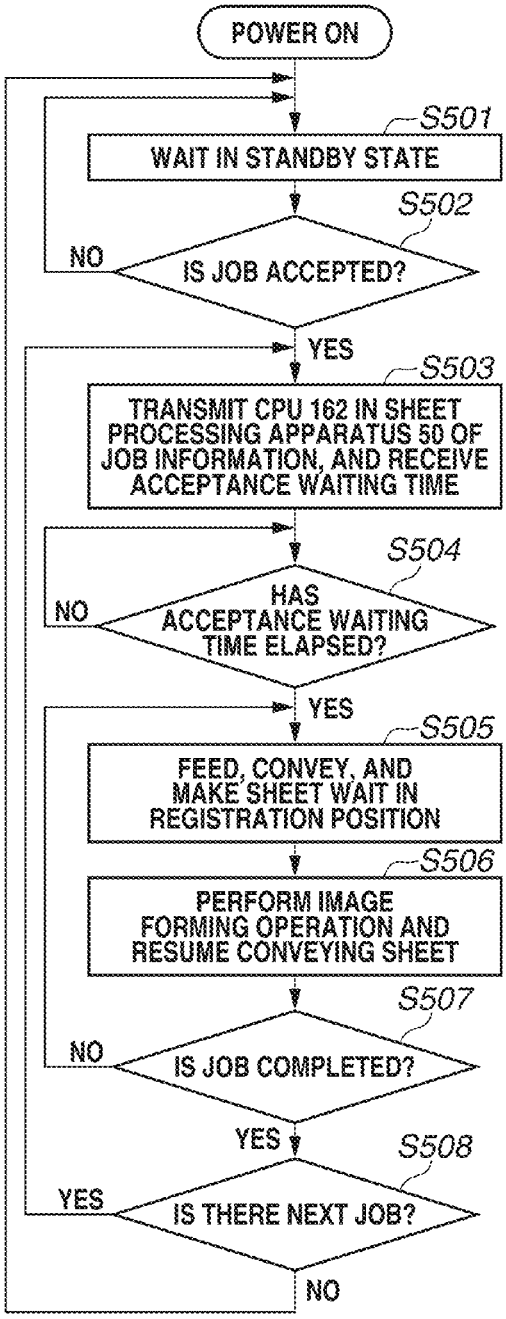
FIGS. 4A and 4B are flowcharts illustrating processing on an image forming apparatus side and a sheet processing apparatus side.
Figure 4B:
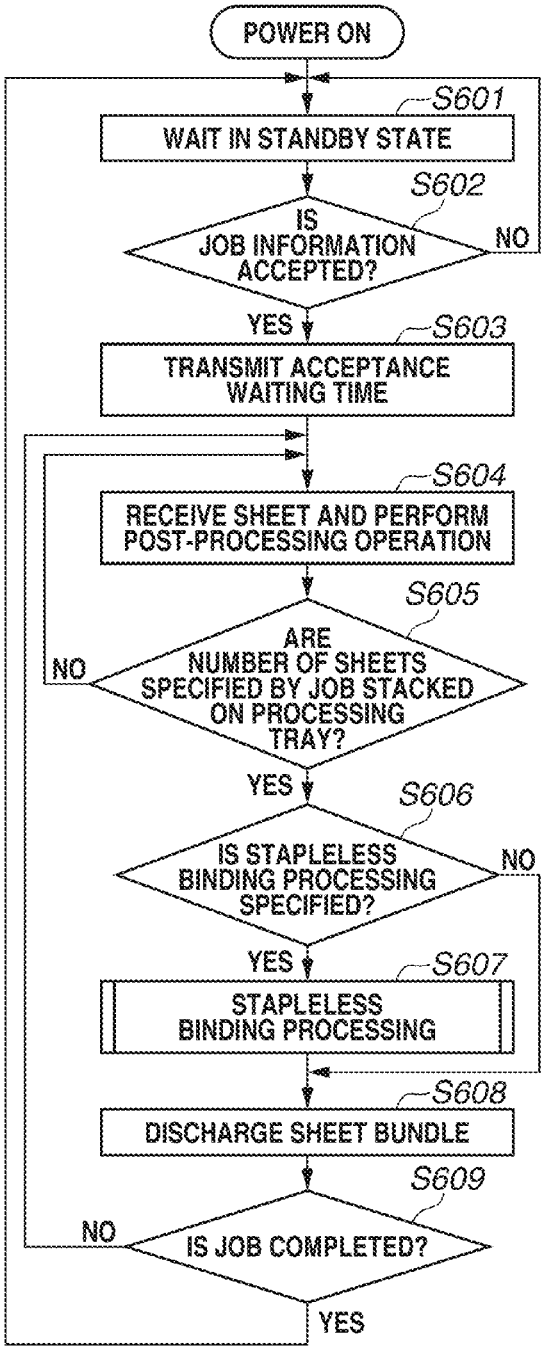

A stapleless binding control sequence using the stapleless binding device 52 of the sheet processing apparatus 50 according to information about a job (hereinafter, referred to as job information) from the image forming apparatus 1 will be described. FIG. 4A is a flowchart of control executed by the CPU 161 in the image forming apparatus 1. FIG. 4B is a flowchart of control executed by the CPU 162 of the sheet processing apparatus 50.

When the image forming apparatus 1 is powered on (power on), the CPU 161 in the image forming apparatus 1 starts the following control. In step S501, the CPU 161 performs an initialization operation and then makes the image forming apparatus 1 wait in a standby state. The standby state refers to a state in which the image forming apparatus 1 waits for the acceptance of a job from the operation unit 40 or the external apparatus. The image forming apparatus 1 can immediately perform an image forming operation when a job is accepted. In step S502, the CPU 161 determines whether a job is accepted from the operation unit 40 or via the network. In step S502, if the CPU 161 determines that a job is not accepted (NO in step S502), the processing returns to step S501. In other words, the CPU 161 maintains the standby state until a job is accepted. The image forming apparatus 1 and the sheet processing apparatus 50 may be configured to shift from the standby state to a power saving state if the state of not accepting a job has lasted for a predetermined time.

In step S502, if the CPU 161 determines that a job is accepted (YES in step S502), then in step S503, the CPU 161 transmits the CPU 162 in the sheet processing apparatus 50 of the accepted job information, and receives acceptance waiting time according to the job information from the CPU 162. The acceptance waiting time refers to a predetermined time needed for the sheet processing time 50 to become ready to start a post-processing operation after receiving a sheet P from the image forming apparatus 1. The CPU 161 resets and starts a not-illustrated timer here. In step S504, the CPU 161 refers to the not-illustrated timer to determine whether the acceptance waiting time received from the CPU 162 in step S503 has elapsed. In step S504, if the CPU 161 determines that the acceptance waiting time has not elapsed (NO in step S504), the processing of step S504 is repeated. In step S504, if the CPU 161 determines that the acceptance waiting time has elapsed (YES in step S504), the processing proceeds to step S505. In step S505, the CPU 161 feeds a sheet P from a sheet cassette 18*a*, conveys the sheet P over the conveyance path, and makes the sheet P wait in a registration position. The registration position is a waiting position for adjusting the timing at which an image is transferred onto the sheet P. In step S506, the CPU 161 performs an image forming operation and resumes conveying the sheet P from the registration position in synchronization with image formation timing. That is, a toner image is transferred onto the sheet P in the transfer position. The fixing unit 19 fixes the unfixed toner image to the sheet P, and then the sheet P is discharged to the sheet processing apparatus 50.

In step S507, the CPU 161 determines whether a predetermined number of sheets has been processed (the job is completed) according to the job information. If the CPU 161 determines that the job is not completed (NO in step S507), the processing returns to step S505. In step S507, if the CPU 161 determines that the job is completed (YES in step S507), then in step S508, the CPU 161 determines whether there is a next job, i.e., whether a next job has been accepted and waiting. In step S508, if the CPU 161 determines that there is a next job (YES in step S508), the processing returns to step S503. If the CPU 161 determines that there is no next job (NO in step S508), the processing returns to step S501.

(Processing on Sheet Processing Apparatus Side)

Next, a control flowchart of the CPU 162 of the sheet processing apparatus 50 will be described with reference to FIG. 4B. When the image forming apparatus 1 is powered on, the sheet processing apparatus 50 is also supplied with power from the image forming apparatus 1 (power on). The power supply activates the CPU 162, and the CPU 162 starts the processing of steps S601 and later. In step S601, the CPU 162 performs an initialization operation of the sheet processing apparatus 50 and then waits in a standby state. In step S602, the CPU 162 determines whether job information is transmitted (job information is accepted) from the CPU 161 in the image forming apparatus 1. In step S602, if the CPU 162 determines that job information is not accepted (NO in step S602), the processing returns to step S601. In step S602, if the CPU 162 determines that job information is accepted (YES in step S602), the processing proceeds to step S603. In step S603, the CPU 162 transmits the CPU 161 in the image information apparatus 1 of the predetermined acceptance waiting time in which the sheet processing apparatus 50 becomes ready to receive a sheet P from the image forming apparatus 1 according to the job information received from the CPU 161. The processing on the side of the CPU 161 in the image forming apparatus 1 corresponds to the processing of step S503 of FIG. 4A described above.

The image forming apparatus 1 discharges a sheet P on which image formation has been completed, and the sheet processing apparatus 50 receives the sheet P. In step S604, the CPU 162 performs a post-processing operation by using the sheet processing apparatus 50. The post-processing operation performed by the sheet processing apparatus 50 is as follows: The CPU 162 makes the conveyance unit 58 convey the sheet P at accelerated conveyance speed, and then drives the puddle roller 49 to rotate so that the sheet P is fed into the processing tray 57. The CPU 162 then performs a trailing edge alignment operation in which a plurality of sheets P on the processing tray 57 is conveyed and made to abut on the trailing edge alignment plate 62 by the return roller 60, whereby the trailing edges of the plurality of sheets P are aligned. After the trailing edge alignment operation, the CPU 162 aligns the plurality of sheets P in the sheet width direction by using the alignment plates 64 and 65, and stacks the plurality of sheets P on the processing tray 57.

In step S605, the CPU 162 determines whether a number of sheets P specified by the job are stacked on the processing tray 57. If the CPU 162 determines that the specified number of sheets P are not stacked (NO in step S605), the processing returns to step S604. The CPU 162 counts the number of sheets discharged to the processing tray 57 by using a not-illustrated sensor arranged on a conveyance path, and determines whether the specified number of sheets P are stacked based on the count value. The sensor may be provided on the conveyance path of either the image forming apparatus 1 or the sheet processing apparatus 50. In step S605, if the CPU 162 determines that the number of sheets P specified by the job are stacked on the processing tray 57 (YES in step S605), the processing proceeds to step S606. In step S606, the CPU 162 determines whether the stapleless binding processing is specified, based on the accepted job information. If the CPU 162 determines that the stapleless binding processing is not specified (NO in step S606), the processing proceeds to step S608. In step S606, if the CPU 162 determines that the stapleless binding processing is specified (YES in step S606), then in step S607, the CPU 162 performs the stapleless binding processing. The stapleless binding processing performed in step S607 will be described below with reference to FIG. 5. In step S608, the CPU 162 pushes out the trailing edge side of the sheet bundle S stacked on the processing tray 57 and discharges the sheet bundle S to the discharge tray 63 by using the bundle pressing members 61. In step S609, the CPU 162 determines whether the post-processing operation of a specified predetermined number of copies is completed (hereinafter, referred to as completion of the job) based on the job information. If the CPU 162 determines that the job is not completed (NO in step S609), the processing returns to step S604. In step S609, if the CPU 162 determines that the job is completed (YES in step S609), the processing returns to step S601.

(Stapleless Binding Processing)

Figure 5:
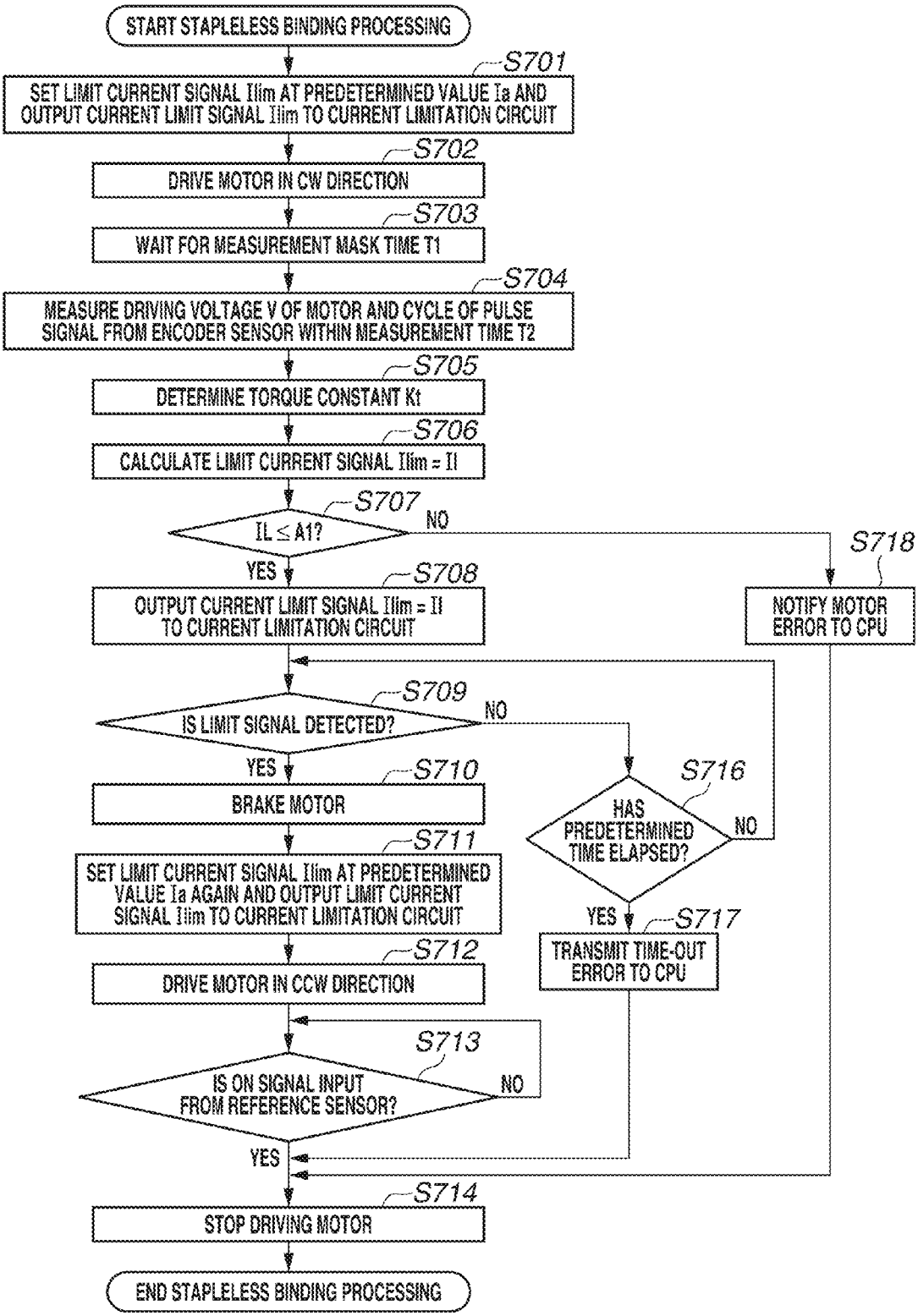
FIG. 5 is a flowchart illustrating stapleless binding processing of the sheet processing apparatus.
Figure 6:
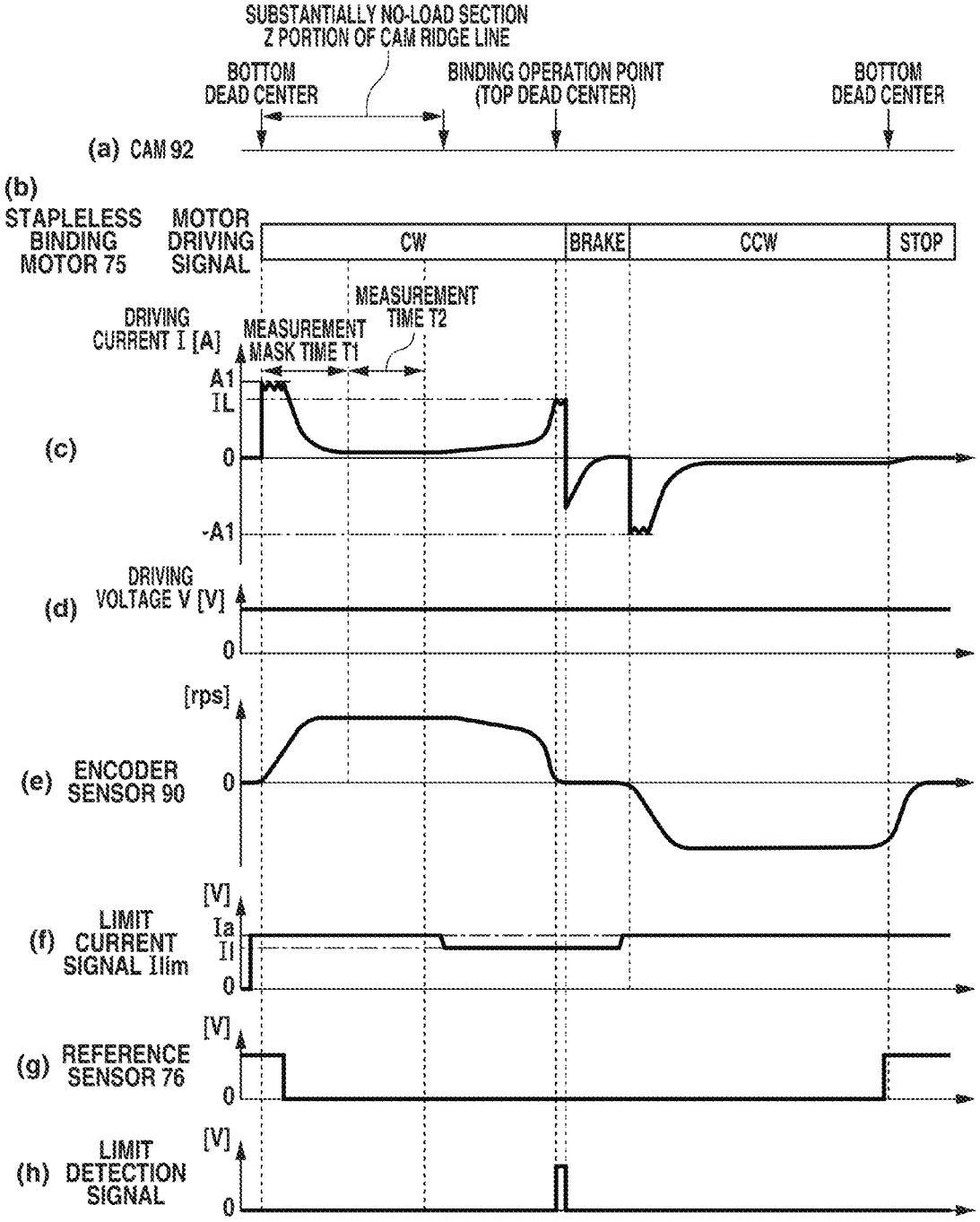
FIG. 6 is a timing chart illustrating an operation sequence during the stapleless binding processing.

Next, the stapleless binding processing by the CPU 162 of the sheet processing apparatus 50 will be described with reference to the flowchart of FIG. 5. FIG. 6 is a timing chart illustrating the signals of various parts of the sheet processing apparatus 50 during the stapleless binding processing. In FIG. 6, a state (a) indicates the state of the cam 92 described in FIGS. 2A and 2B, including the "bottom dead center" and a "binding operation point (top dead center)." A signal (b) of FIG. 6 indicates the motor driving signal of the motor 75. In FIG. 6, clockwise (CW) of the signal (b) represents forward rotation, BRAKE a stop of rotation, counterclockwise (CCW) reverse rotation, and STOP a stop of driving. In the present exemplary embodiment, CW is thus described as forward rotation and CCW as reverse rotation. A waveform (c) of FIG. 6 indicates the waveform of the driving current I [A]. A current value according to a predetermined value Ia stored in the RAM 168 is denoted as A1. The limit current value is denoted as IL and indicated by a dashed-dotted line. A waveform (d) of FIG. 6 indicates the waveform of the driving voltage V [V] for driving the motor 75. A waveform (e) of FIG. 6 indicates the number of rotations per unit time (second) [rps] of the motor 75 detected by the encoder sensor 90. A waveform (f) of FIG. 6 indicates the limit current signal [V] which the CPU 162 outputs to the current limitation circuit 100. A waveform (g) of FIG. 6 indicates the detection signal [V] that the reference sensor 76 outputs to the CPU 162. A waveform (h) of FIG. 6 indicates the limit detection signal [V] which the current limitation circuit 100 outputs to the CPU 162. The horizontal axis of FIG. 6 is time.

Figure 8A:
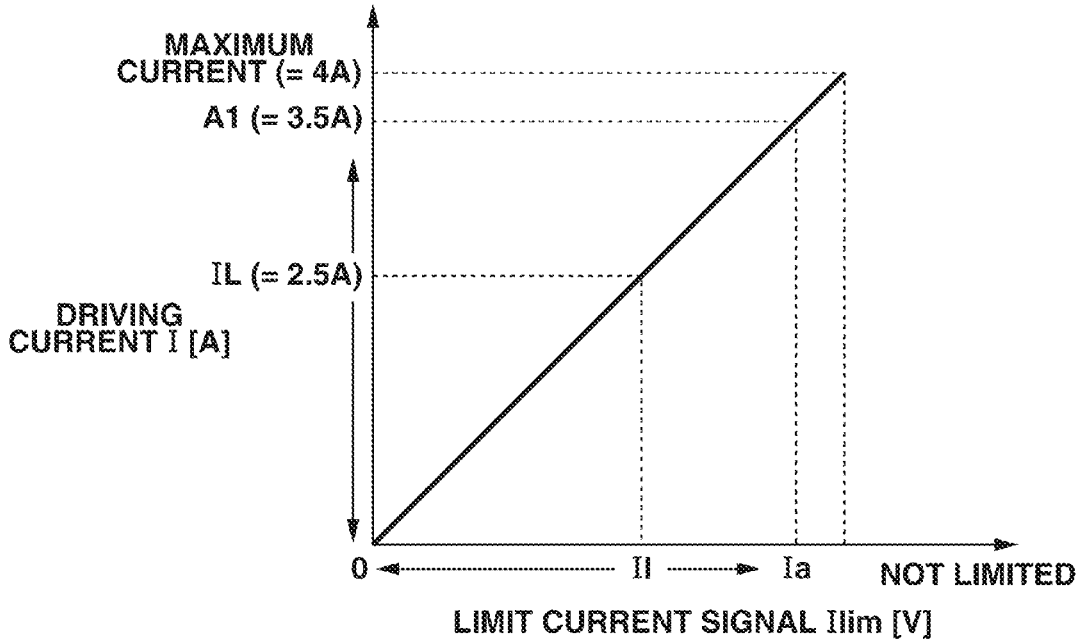
FIG. 8A is a graph illustrating a relationship between a limit current signal and a driving current.

In step S607 of FIG. 4B, the CPU 162 performs the stapleless binding processing. In step S701 of FIG. 5, the CPU 162 sets a limit current signal Ilim (V) at a predetermined value Ia (V) stored in a not-illustrated storage unit in the CPU 162 in advance, and outputs the limit current signal Ilim to the current limitation circuit 100. The CPU 162 thus functions as a setting unit for setting the driving current I of the motor 75 controlled by the current limitation circuit 100. As illustrated in FIG. 8A, the predetermined value Ia is determined so that when the limit current signal Ilim is set at the predetermined value Ia, the driving current I of the motor 75 falls to or below a maximum current that can be passed through the motor 75. The maximum current that can be passed through the motor 75 is the driving current corresponding to maximum output torque within the range of torque that the motor 75 can output. In step S702, to perform the stapleless binding processing, the CPU 162 outputs the motor driving signal to the driving circuit 82 so that the driving circuit 82 drives the motor 75 in a forward rotation (CW) direction. By driving the motor 75 in the forward rotation direction, the CPU 162 rotates the cam 92 in the X direction (counterclockwise) from the bottom dead center as illustrated in FIG. 2A. In the present exemplary embodiment, when the CPU 162 starts to drive the motor 75 via the driving circuit 82, the motor 75 is driven by using the current value corresponding to the limit current signal Ia set in step S701 as the driving current I of the motor 75.

The driving current I according to the limit current signal Ia is treated as the current value A1 (a first current value). As indicated by the waveform (f) of FIG. 6, if the limit current signal Ilim is set at the predetermined value Ia, the driving current I of the motor 75 becomes A1 [A] as indicated by the waveform (c) of FIG. 6. As described above, if the limit current signal Ilim is set at the predetermined value Ia, the current value A1 according to the predetermined value Ia falls to or below the driving current corresponding to the maximum output torque of the motor 75. The current value A1 according to the limit current signal Ia can thus be said to be a current limitation value to determine the upper limit value of the current. Hereinafter, the driving current A1 may be referred to as a current limitation value A1. The value of the driving current I=A1 when the limit current signal Ilim has the predetermined value Ia is determined according to a maximum driving current that the driving circuit 82 can output. For example, in the present exemplary embodiment, the current limitation value A1 is determined to be 3.5 A (amperes).

As illustrated in FIG. 8A to be described below, in the present exemplary embodiment, the maximum current of the motor 75 (also referred to as a lock current) is 4 A, for example. In other words, if the CPU 162 does not limit the limit current signal to the current limitation circuit 100 (no limitation), a driving current of up to 4 A can be passed through the motor 75. The maximum value of the current that can be passed through the motor 75 is a value determined by each individual motor 75. FIG. 8A is a graph in which the horizontal axis indicates the limit current signal Ilim [V] and the vertical axis the driving current I [A]. When the limit current signal Ilim is set at the predetermined value Ia in step S701, the driving current I becomes A1 (=3.5 A) as described above. In the present exemplary embodiment, by starting to drive the motor 75 with the driving current I=A1 [A], the motor 75 can be quickly activated against inertial load of the foregoing speed reduction mechanism 91.

Figure 8B:
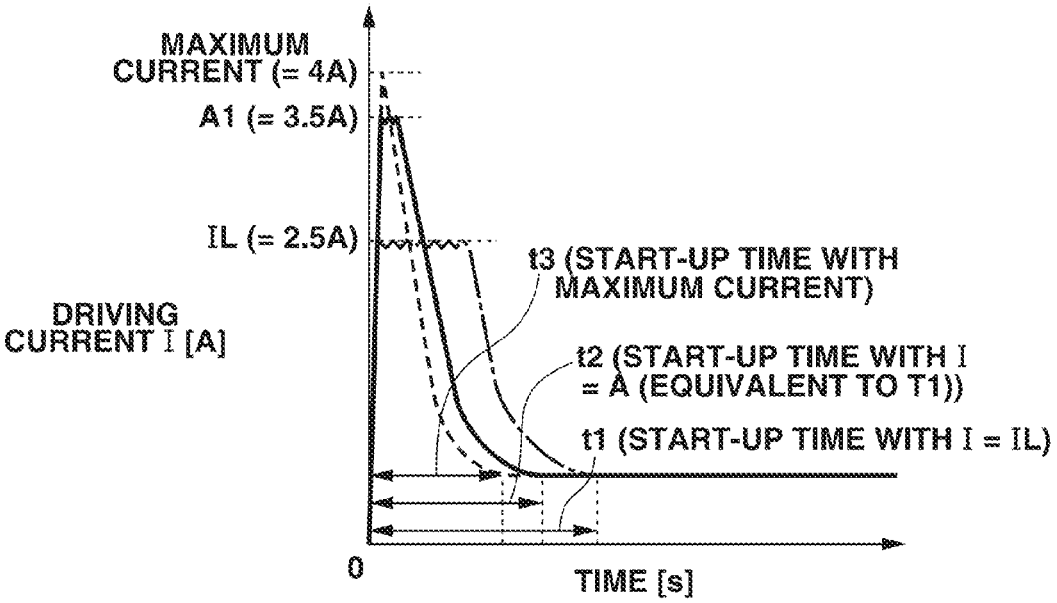
FIG. 8B is a graph illustrating a relationship between start-up time and the driving current.

FIG. 8B illustrates a relationship between the driving current I and start-up time of the motor 75. The start-up time of the motor 75 refers to time needed for the motor 75 to stabilize after a start of driving. FIG. 8B is a graph in which the horizontal axis indicates time [s] and the vertical axis the driving current I [A]. In FIG. 8B, the dashed-dotted line indicates plots when the driving current I at the start of driving of the motor 75 is IL (=2.5 A), in which case the start-up time is t1 [s]. In FIG. 8B, the solid line indicates plots when the driving current I at the start of driving of the motor 75 is A1 (=3.5 A), in which case the start-up time is t2 [s]. In FIG. 8B, the broken line indicates plots when the driving current I at the start of driving of the motor 75 is the maximum current (=4 A), in which case the start-up time is t3 [s]. As illustrated in FIG. 8B, the higher the driving current I when starting the motor 75 is set, the shorter the start-up time (t1>t2>t3). The reason is that the higher the driving current I when starting the motor 75 is set, the higher the output torque of the motor 75 becomes in proportion to the driving current I and the shorter the time needed to drive the load becomes in proportion to the output torque. The driving current I (current limitation value A1) when starting the motor 75 may have either the upper limit value of the current (the lock current (in the present exemplary embodiment, 4 A)) or any current value at which the start-up time becomes the predetermined time. The CPU 162 resets and starts a not-illustrated timer.

In step S703, the CPU 162 refers to the not-illustrated timer to wait for a measurement mask time T1 before measurement of the driving voltage V and rotation speed of the motor 75. The processing of step S703 is performed to exclude from measurement targets a period in which the driving voltage V and rotation speed of the motor 75 vary due to the inertial load of the speed reduction mechanism 91 immediately after the start of driving. As indicated by the waveforms (c) and (e) of FIG. 6, the driving current I and the output from the encoder 90 are unstable during the period of the measurement mask time T1. The measurement mask time T1 is a fixed value or a value determined for each stapleless binding device 52. For example, the measurement mask time T1 is stored in the ROM 167 in advance. The measurement mask time T1 is set at a value greater than or equal to the foregoing start-up time.

In step S704, the CPU 162 measures the voltage Vm obtained by the conversion circuit 102 converting the driving voltage V for driving the motor 75 a plurality of times. The driving voltage V varies considerably. Accordingly, in the present exemplary embodiment, the voltages Vm measured a plurality of times are averaged to improve measurement accuracy. The CPU 162 also measures an edge interval (i.e., equivalent to cycle) of the pulse signal input from the encoder sensor 90 a plurality of times, and averages the measurement results to calculate the rotation speed of the motor 75. The CPU 162 performs such measurements in measurement time T2. The measurement time T2 is set not to be longer than a difference between the measurement mask time T1 and the time in which the contact portion between the roller 93 and the cam 92 moves through the Z portion (FIG. 2A) of the cam 92. The time in which the roller 93 moves through the Z portion of the cam 92 will hereinafter be referred to as a movement period. The measurement time T2 is set to fall within a time obtained by subtracting the measurement mask time T1 from the movement period. In other words, the measurement time T2 is set so that current measurement is performed within a no-load period where little load acts on the motor 75. More specifically, the current measurement is performed in a period in which the motor 75 is being driven and the upper teeth 97 are not pressing the sheet bundle S. The measurement time T2 is stored in the ROM 167. The predetermined ridge line distance (Z portion) which defines the no-load section has a fixed value or a value set according to the shape of the cam 92. In such a manner, the CPU 162 measures the driving voltage V of the motor 75 and the cycle of the pulse signal from the encoder sensor 90 within the measurement time T2.

The CPU 162 resets and starts a not-illustrated timer in advance, and refers to the timer to measure the measurement time T2. As indicated by the waveforms (c) and (e) of FIG. 6, the driving current I and the output of the encoder 90 are stable during the period of the measurement time T2.

(Determination of Torque Constant Kt)

In step S705, the CPU 162 determines a torque constant Kt based on the cycle of the pulse signal from the encoder sensor 90 and the voltage Vm according to the driving voltage V of the motor 75, measured in step S704. In other words, the CPU 162 also functions as a determination unit for determining torque. The determination of the torque constant Kt by the CPU 162 is described in detail below. The CPU 162 determines an average value of the voltage Vm according to the driving voltage V measured a plurality of times. The CPU 162 converts the average value of the voltage Vm into the driving voltage V of the motor 75 by using data (Table 1) indicating a relationship between the voltage Vm and a motor driving voltage V, stored in the ROM 167 in advance. Table 1 lists average values of the voltage Vm [V] on the left column and driving voltages V [V] of the motor 75 converted from the respective average values of the voltage Vm on the right column. For example, if the voltage Vm has an average value of 1.35 V, the CPU 162 converts the driving voltage V of the motor 75 into 22.89 V.

TABLE 1

| Voltage Vm [V] | Motor Driving Voltage V [V] |
|---|---|
| 1.1 | 18.65 |
| 1.15 | 19.50 |
| 1.2 | 20.35 |
| 1.25 | 21.20 |
| 1.3 | 22.04 |
| 1.35 | 22.89 |
| 1.4 | 23.74 |
| 1.45 | 24.59 |
| 1.5 | 25.44 |
| 1.55 | 26.28 |
| 1.6 | 27.13 |

The CPU 162 further averages a plurality of measurement results of the pulse signal cycle from the encoder sensor 90 to calculate an average value Te. The CPU 162 then calculates a rotation angular speed ωm of the motor 75 from the average value Te of the pulse signal cycle from the encoder sensor 90 by using the following previously prepared equation (1):

$$\omega m=2\times\pi\times(1\div Te)\div 18 \quad (1)$$

The rotation angular speed am is in units of [rad/s], and the average value Te in units of [sec]. The numerical value of 18 in equation (1) is the number of slits formed in the disk on the output shaft of the motor 75.

Figure 7:
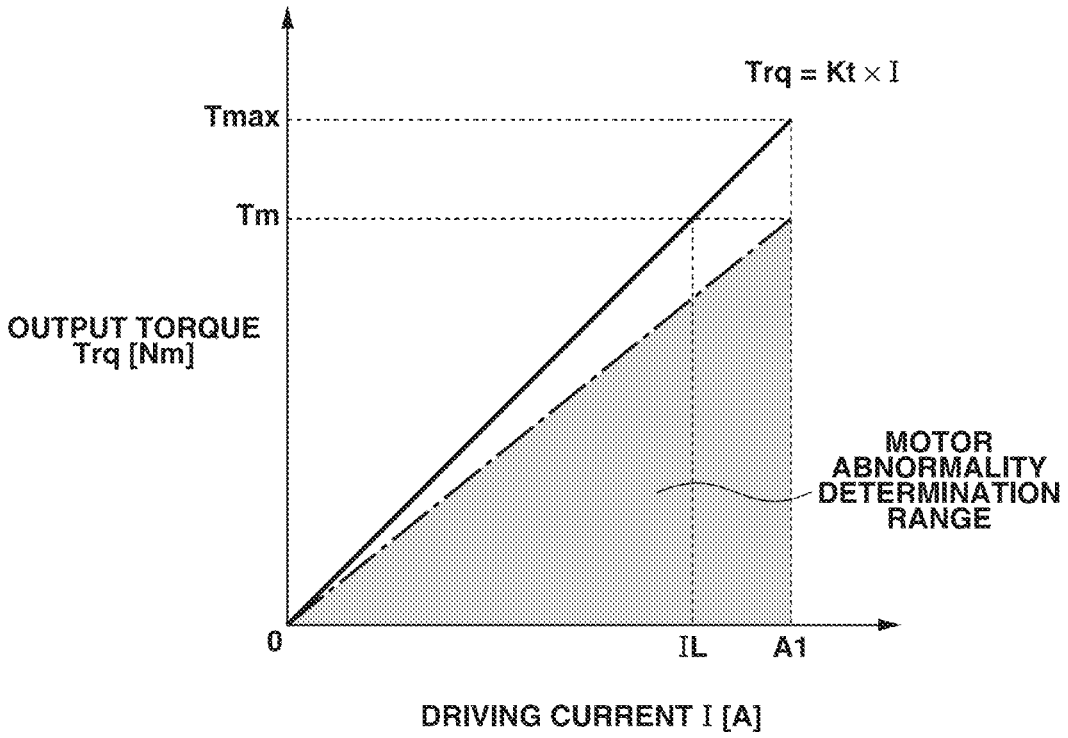
FIG. 7 is a graph illustrating an output torque characteristic and a motor abnormality determination range.

Here, the CPU 162 determines the torque constant Kt of the motor 75. FIG. 7 is a graph illustrating a relationship between the driving current I and output torque Trq of the motor 75, in which the horizontal axis indicates the driving current I [A] and the vertical axis the output torque Trq [Nm]. The following relationship holds:

$$Trq=Kt\times I.$$

The torque constant Kt corresponds to the gradient of the straight line illustrated in FIG. 7 and expresses an output torque characteristic of the motor 75. The torque constant Kt of the motor 75 is known to typically have a value equal to a back electromotive force constant Ke. Thus, $$Kt=Ke \quad (2)$$

Further, the back electromotive force constant Ke can be calculated by the following equation (3):

$$Ke=V\div\omega m, \quad (3)$$

where V is the driving voltage converted from the voltage Vm of the motor 75, and ωm the rotation angular speed of the motor 75.

The CPU 162 can thus determine the torque constant Kt of the motor 75 by using equation (4) derived from equations (2) and (3):

$$Kt=Ke=V\div\omega m \quad (4)$$

The torque constant Kt is in units of [Nm/A], the driving voltage V in units of [V], and the rotation angular speed cm in units of [rad/s]. In such a manner, the CPU 162 determines the torque constant Kt based on the measurement results of the voltage Vm according to the driving voltage V of the motor 75 and the cycle of the pulse signal from the encoder sensor 90 (equivalent to the rotation speed) in step S704. In the present exemplary embodiment, the CPU 162 determines the output torque characteristic, i.e., the torque constant Kt of the motor 75 based on the detection results of the rotation speed and the driving voltage V of the motor 75. Based on the determined torque constant Kt of the motor 75, the CPU 162 then controls the driving current I of the motor 75 so that the upper teeth 97 and the lower teeth 98 apply constant pressing force to the sheet bundle S.

In step S706, the CPU 162 calculates the limit current signal Ilim based on the torque constant Kt determined in step S705 and outputs the calculated limit current signal Ilim to the current limit circuit 100. As illustrated in FIG. 7, if the output torque needed for the stapleless binding processing is Tm [Nm], a driving current of IL [A] is needed to obtain the output torque Tm. The output torque Tm needed for the stapleless binding processing is a value determined for each individual stapleless binding device 52 by experiment in advance and stored in the ROM 167. The driving current IL [A] is the limit current value. From the torque constant Kt determined in step S705, the CPU 162 determines the limit current value IL (a second current value), by using equation (5):

$$IL=Tm\div Kt. \quad (5)$$

The limit current value IL is in units of [A], the torque constant Kt in units of [A] [Nm/A], and the output torque Tm in units of [A] [Nm].

The CPU 162 stores the determined limit current value IL in the RAM 168 and outputs the limit current signal Ilim (voltage signal) according to the limit current value IL to the current limitation circuit 100. The limit current signal Ilim will be referred to as a limit current signal I1.

In step S707, the CPU 162 determines whether the limit current value IL determined in step S706 is less than or equal to the driving current A1 that the driving circuit 82 can output (in the present exemplary embodiment, 3.5 A). In step S707, if the CPU 162 determines that the limit current value IL determined in step S706 is not less than or equal to the driving current A1, i.e., IL>A1 (NO in step S707), the processing proceeds to step S718. In step S718, since the torque constant Kt of the motor 75 has an abnormal value (value not possible in normal conditions), the CPU 162 determines that the motor 75 is in an abnormal state, and transmits a motor error to the CPU 161 in the image forming apparatus 1. The processing then proceeds to step S714.

An output torque Tmax illustrated in FIG. 7 is a value determined in consideration of variations of the motor 75.

The output torque Tmax is the maximum output torque that the motor 75 can output. The driving current A1 is a current value that is set so that the output torque Trq [Nm] has an intermediate value between the output torque Tm needed for the binding processing and the maximum output torque Tmax. The driving current A1 (i.e., current limitation value A1) falls below the limit current value IL in situations where the gradient of the graph illustrated in FIG. 7 (i.e., torque constant Kt) is less than Tm÷A1 (Kt<Tm÷A1). In FIG. 7, the dashed-dotted line indicates a line of Trq=Tm/A1×I. If the driving current I and the output torque Trq fall within a motor abnormality determination range (shaded area in FIG. 7), the CPU 162 determines the motor 75 to be in an abnormal state. That the motor 75 is in the abnormal state refers to a state where the motor 75 is unable to output the output torque Tm needed for the binding processing. In such a manner, the CPU 162 imposes limitations so that the driving current I of the motor 75 or the limit current value IL at the time of the binding processing does not flow through the motor 75 beyond the current limitation value A1.

In step S707, if the CPU 162 determines that the limit current value IL is less than or equal to the driving current A1 (IL≤A1) (YES in step S707), the processing proceeds to step S708. In step S708, the CPU 162 outputs the limit current signal I1 according to the limit current value IL determined in step S706 to the current limitation circuit 100. That is, in the present exemplary embodiment, the driving current I of the motor 75 when pressing the sheet bundle S is set at the limit current value IL (IL≤A1). As illustrated by the waveform (f) of FIG. 6, after a lapse of the measurement time T2, the limit current signal Ilim is changed to the limit current signal I1 according to the limit current value IL. In step S709, the CPU 162 determines whether the limit signal is detected. As described above, the current limitation circuit 100 controls the driving circuit 82 so that the driving current I of the motor 75 will not exceed the limit current value IL according to the limit current signal I1 input from the CPU 162. The motor 75 continues forward rotation to continue rotating the cam 92. As the cam 92 approaches the top dead center, the driving current I of the motor 75 increases. When the driving current I of the motor 75 reaches the limit current value IL, the current limitation circuit 100 outputs the limit signal to the CPU 162 (the waveform (h) of FIG. 6)).

In step S709, if the CPU 162 determines that the limit signal is not detected (NO in step S709), the processing proceeds to step S716. In step S716, the CPU 162 refers to the timer started in step S701 to determine whether a predetermined time has elapsed. Here, the predetermined time is set at time exceeding the time needed for the binding processing. In step S716, if the CPU 162 determines that the predetermined time has not elapsed (NO in step S716), the processing returns to step S709. In step S716, if the CPU 162 determines that the predetermined time has elapsed (YES in step S716), then in step S717, the CPU 162 transmits a time-out error to the CPU 161 in the image forming apparatus 1 because it is likely that the motor 75 is not normally driven. The processing then proceeds to step S714.

In step S709, if the CPU 162 determines that the limit signal is detected (YES in step S709), the processing proceeds to step S710. In step S710, the CPU 162 outputs the motor driving signal to the driving circuit 82 such that the driving current I is maintained at the limit current value IL for a certain time and that the motor 75 is braked after that. The CPU 162 thereby brakes the motor via the driving circuit 82 and stops the forward rotation of the motor 75. The upper teeth 97 and the lower teeth 98 mesh with the sheet bundle S at a predetermined pressure needed for binding, whereby the stapleless binding processing is performed on the sheet bundle S. The forward rotation driving of the motor 75 is quickly stopped so that the predetermined pressure is not applied to the sheet bundle S longer than needed.

In step S711, the CPU 162 sets the predetermined value Ia stored in the ROM 162 as the limit current signal Ilim again, and outputs the limit current signal Ilim to the current limitation circuit 100. In such a manner, when driving the motor 75 from a stopped state, the CPU 162 drives the motor 75 by the driving current A1 that is higher than the limit current value IL regardless of forward rotation or reverse rotation. As indicated by the waveform (f) of FIG. 6, the limit current signal Ilim is changed from the limit current signal I1 according to the determined limit current value IL to the predetermined value Ia according to the driving current A1 a predetermined time later after the motor driving signal indicated by the signal (b) of FIG. 6 is switched from CW to BRAKE.

In step S712, the CPU 162 outputs the motor driving signal to the driving circuit 82 so that the driving circuit 82 drives the motor 75 in a reverse rotation (CCW) direction to rotate the cam 92 in the direction of the arrow Y in FIG. 2B (clockwise). The CPU 162 thereby separates the upper teeth 97 and the lower teeth 98 from the sheet bundle S. Similar to a case where driving the motor 75 in the forward rotation direction in step S702, the current limitation circuit 100 controls the driving current I when starting the motor 75 in the reverse rotation direction, to be the driving current A1 according to the limit current signal Ia. In the present exemplary embodiment, driving the motor 75 by the driving current I=A1 enables quick start-up against the inertial load of the speed reduction mechanism 91. In step S713, the CPU 162 determines whether the ON signal is input from the reference sensor 76. If the CPU 162 determines that the ON signal is not input from the reference sensor 76 (NO in step S713), the processing returns to step S713. In step S713, if the CPU 162 determines that the ON signal is input from the reference sensor 76 (YES in step S713), then in step S714, the CPU 162 stops driving the motor 75 via the driving circuit 82 and ends the stapleless binding processing.

In the present exemplary embodiment, when performing the binding processing, the CPU 162 controls the limit value of the driving current I of the motor 75 to be the limit current value IL so that the output torque Tm equivalent to the pressing force of the upper teeth 97 and the lower teeth 98 is obtained. When performing operations other than the binding processing, the CPU 162 controls the driving of the motor 75 by using the driving current A1 equal to or higher than the limit current value IL as the limit value. In other words, in the present exemplary embodiment, the CPU 162 controls the motor 75 by switching the driving current I of the motor 75 according to the sequence of the binding processing operation. As a result, when starting to drive the motor 75, the start-up time of the motor 75 can be reduced. During the binding processing operation, the driving current I of the motor 75 can be controlled to obtain the output torque needed for the binding processing so that stable pressing force can be applied to the sheet bundle S.

The driving current I at the time of start-up of the motor 75 which is set in step S701 may be determined based on a limit current value IL determined in the previous execution of the binding processing. In such a case, to reduce the start-up time, the driving current I at the time of start-up is set at a value higher than the limit current value IL.

As has been described above, according to the present exemplary embodiment, the quality of the binding processing can be improved to enhance the productivity of the binding processing.

A second exemplary embodiment will be described below. In the first exemplary embodiment, the driving current I of the motor 75 is controlled. In the second exemplary embodiment, the timing to stop driving the motor 75 is controlled. The configuration of the image forming apparatus 1 (FIG. 1A), the configuration of the sheet processing apparatus 50 (FIG. 1B), and the configuration of the stapleless binding device 52 (FIGS. 2A and 2B) are similar to those of the first exemplary embodiment. A description thereof will be omitted and only difference from the first exemplary embodiment will be described below.

(Control Blocks of Image Forming Apparatus and Sheet Processing Apparatus)

Figure 9:
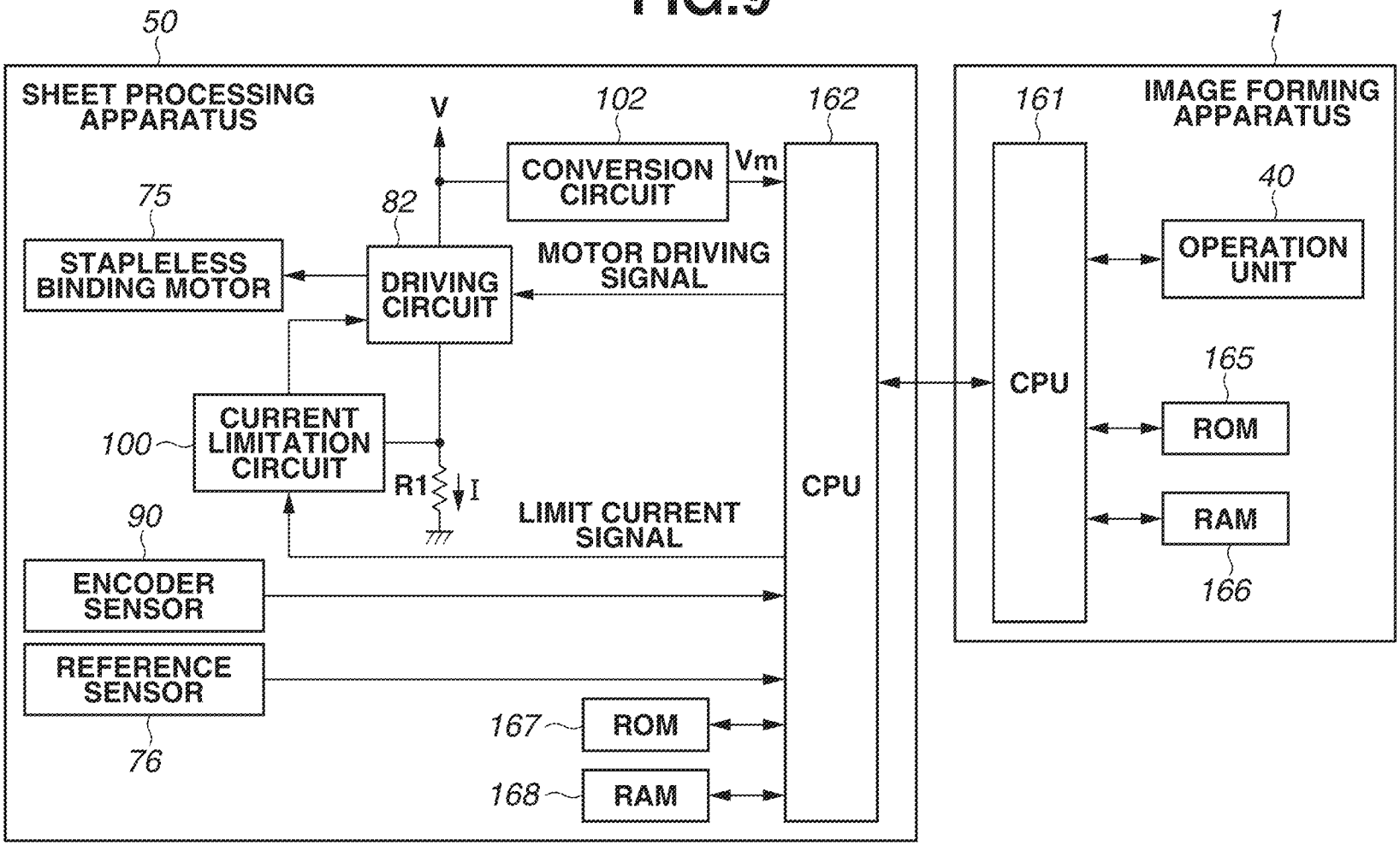
FIG. 9 is a block diagram of an image forming apparatus and a sheet processing apparatus according to a second exemplary embodiment.

FIG. 9 is a control block diagram of the sheet processing apparatus 50 and the image forming apparatus 1 according to the second exemplary embodiment. Similar components to those of FIG. 3 are denoted by the same reference numerals. A difference from FIG. 3 lies in that the limit signal from the current limitation circuit 100 is omitted. In other respects, the configuration is similar to that of FIG. 3. A description thereof will thus be omitted.

(Stapleless Binding Processing)

Figure 10:
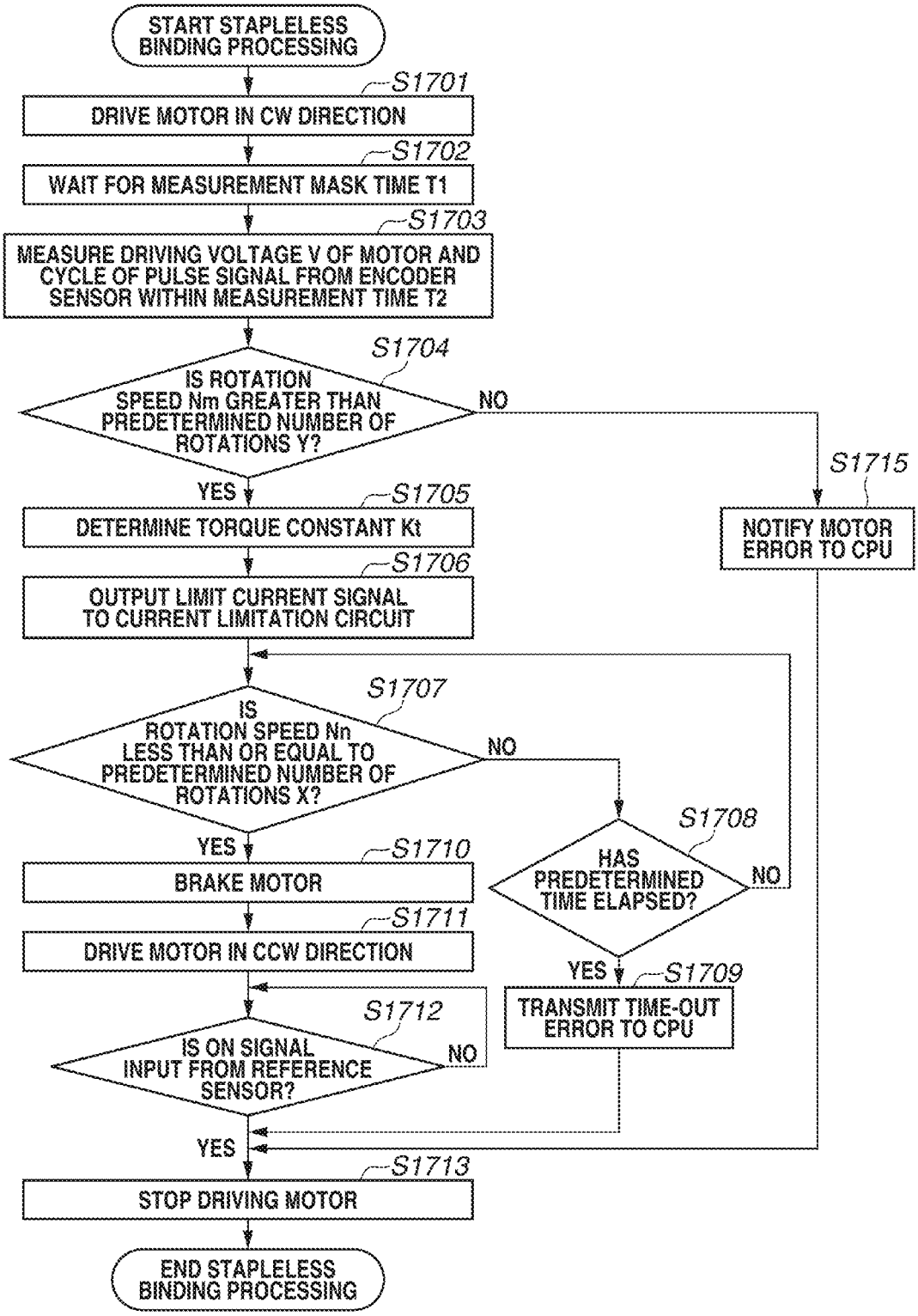
FIG. 10 is a flowchart illustrating stapleless binding processing of the sheet processing apparatus according to the second exemplary embodiment.
Figure 11:
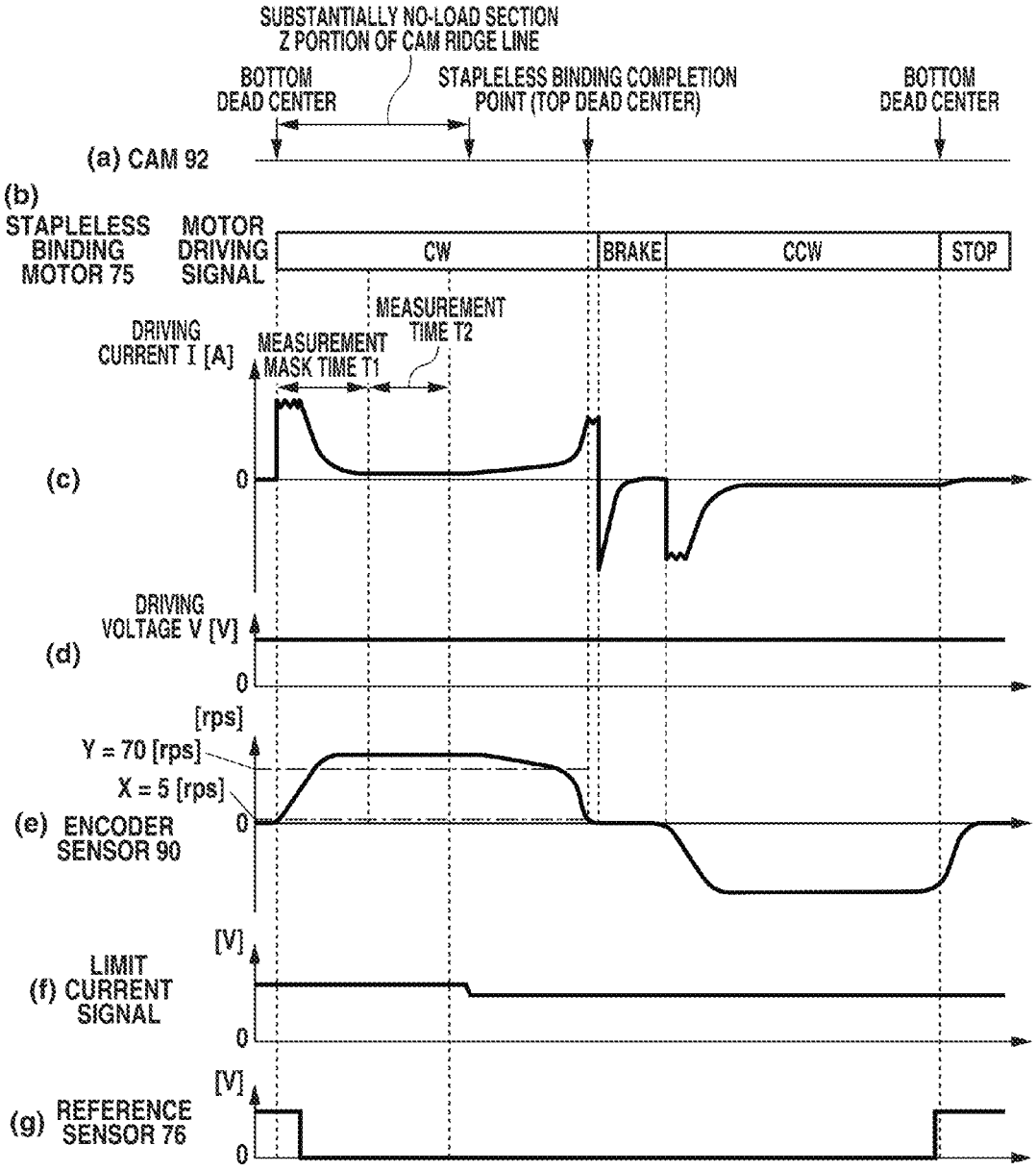
FIG. 11 is a timing chart illustrating an operation sequence during the stapleless binding processing according to the second exemplary embodiment.

Next, the stapleless binding processing by the CPU 162 of the sheet processing apparatus 50 will be described with reference to the flowchart of FIG. 10. The flowcharts of the processing other than the stapleless binding processing are the same as those of FIGS. 4A and 4B. FIG. 11 is a timing chart illustrating the signals of various parts of the sheet processing apparatus 50 during the stapleless binding processing. A state (a) of FIG. 11 indicates the states of the cam 92. A signal (b) of FIG. 11 indicates the motor driving signal. Waveforms (c) to (g) of FIG. 11 are waveforms at the same points in the waveforms (c) to (g) of FIG. 6.

In step S607 of FIG. 4B, the CPU 162 performs the stapleless binding processing. FIG. 10 illustrates details of step S607. In step S1701 of FIG. 10, to perform the stapleless binding processing, the CPU 162 outputs the motor driving signal to the driving circuit 82 so that the driving circuit 82 drives the motor 75 in the forward rotation (CW) direction. By driving the motor 75 in the forward rotation direction, the CPU 162 rotates the cam 92 in the X direction (counterclockwise) from the bottom dead center as illustrated in FIG. 2A. The CPU 162 resets and starts a not-illustrated timer here. In step S1702, the CPU 162 refers to the not-illustrated timer to wait for a measurement mask time T1 until the driving voltage V and rotation speed of the motor 75 are measured. The reason to perform the processing of step S1702 is the same as the processing of step S703 in FIG. 5.

In step S1703, the CPU 162 measures the voltage Vm obtained by the conversion circuit 102 converting the driving voltage V for driving the motor 75, a plurality of times. Details of step S1703 are similar to those of step S704 in FIG. 5.

(Determination of Rotation Speed and Torque Constant Kt of Motor)

Determination of a rotation speed Nm and the torque constant Kt of the motor 75 by the CPU 162 will be described in detail below. The CPU 162 determines an average value of the voltages Vm according to the driving voltage V measured a plurality of times. The CPU 162 converts the average value of the voltage Vm into the driving voltage V of the motor 75 by using the data (Table 1) indicating the relationship between the voltage Vm and the motor driving voltage V, stored in the ROM 167 in advance. Table 1 is the same as described in the first exemplary embodiment.

The CPU 162 further calculates an average value Te of a plurality of measurement results of the cycle of the pulse signal from the encoder sensor 90. The CPU 162 then calculates the rotation angular speed cm (angle of rotation per unit time) and the rotation speed Nm (the number of rotations per unit time) from the average value Te by using the foregoing equation (1) and the following equation (6):

$$\omega m = 2 \times \pi \times (1 \div Te) \div 18, \text{ and} \quad (1)$$

$$Nm = (1 \div Te) \div 18 \quad (6)$$

The rotation angular speed cm is in units of [rad/s], the average value in units of Te [s], and the rotation speed in units of Nm [rps]. The numerical value of 18 in equations (1) and (6) is the number of slits formed in the disk on the output shaft of the motor 75.

In step S1704, the CPU 162 determines whether the calculated rotation speed Nm is greater than a predetermined number of rotations Y stored in the ROM 167 in advance. In step S1704, if the CPU 162 determines that the rotation speed Nm is smaller than or equal to the predetermined number of rotations Y (Nm Y) (NO in step S1704), the CPU 162 determines that the rotation speed of the motor 75 is not in a normal state. The processing then proceeds to step S1715. The predetermined number of rotations Y is a value determined from a lower limit value of the number of rotations in consideration of rotation speed characteristics of the motor 75, the environment where the stapleless binding device 52 is installed, and the use time and use frequency of the stapleless binding device 52. For example, in the present exemplary embodiment, Y=70 [rps] (see the waveform (e) of FIG. 11). In step S1715, the CPU 162 transmits an motor error to the CPU 161 in the image forming apparatus 1. The processing then proceeds to step S1713. In such a manner, the CPU 162 stops driving the motor 75 if the rotation speed of the motor 75 detected by the encoder sensor 90 is smaller than or equal to a predetermined rotation speed after a lapse of the measurement mask time T1 and the measurement time T2 from the start of driving of the motor 75.

On the other hand, in step S1704, if the CPU 162 determines that the rotation speed Nm of the stapleless binding motor 75 is greater than the predetermined number of rotations Y (Nm>Y) (YES in step S1704), the CPU 162 determines that the stapleless binding motor 75 is rotating in a normal range. The processing then proceeds to step S1705. In such a manner, the CPU 162 continues the binding processing if the rotation speed of the motor 75 detected by the encoder sensor 90 is greater than the predetermined rotation speed after a lapse of the measurement mask time T1 and the measurement time T2 from the start of driving of the motor 75. In the present exemplary embodiment, when the motor 75 is normally driven, the rotation speed of the motor 75 is 90 rps (see FIG. 12B). In step S1705, the CPU 162 determines the torque constant Kt based on the cycle of the pulse signal from the encoder sensor 90 and the voltage Vm according to the driving voltage V of the motor 75 measured in step S1703. The CPU 162 determines the torque constant Kt in a similar manner to that of the first exemplary embodiment.

In step S1706, the CPU 162 outputs the limit current signal to the current limitation circuit 100 based on the determined torque constant Kt. Details of step S1706 are similar to those of step S706 in FIG. 5.

Figure 12A:
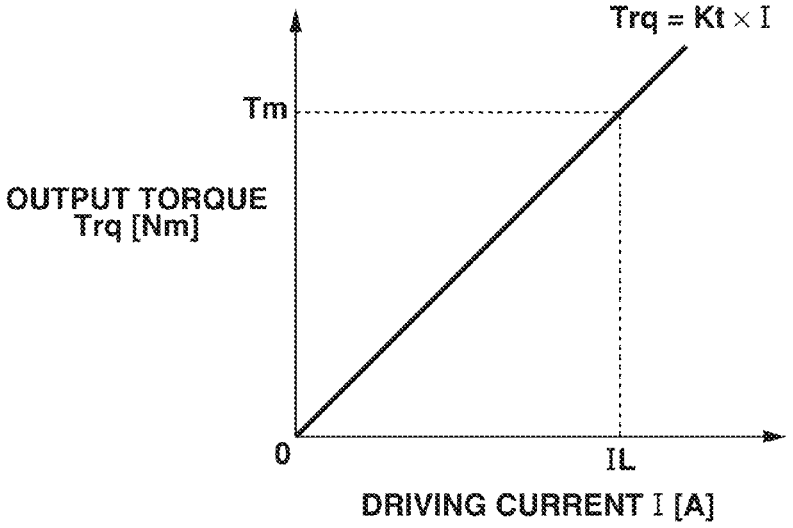
FIG. 12A is a graph illustrating an output torque characteristic according to the second exemplary embodiment.
Figure 12B:
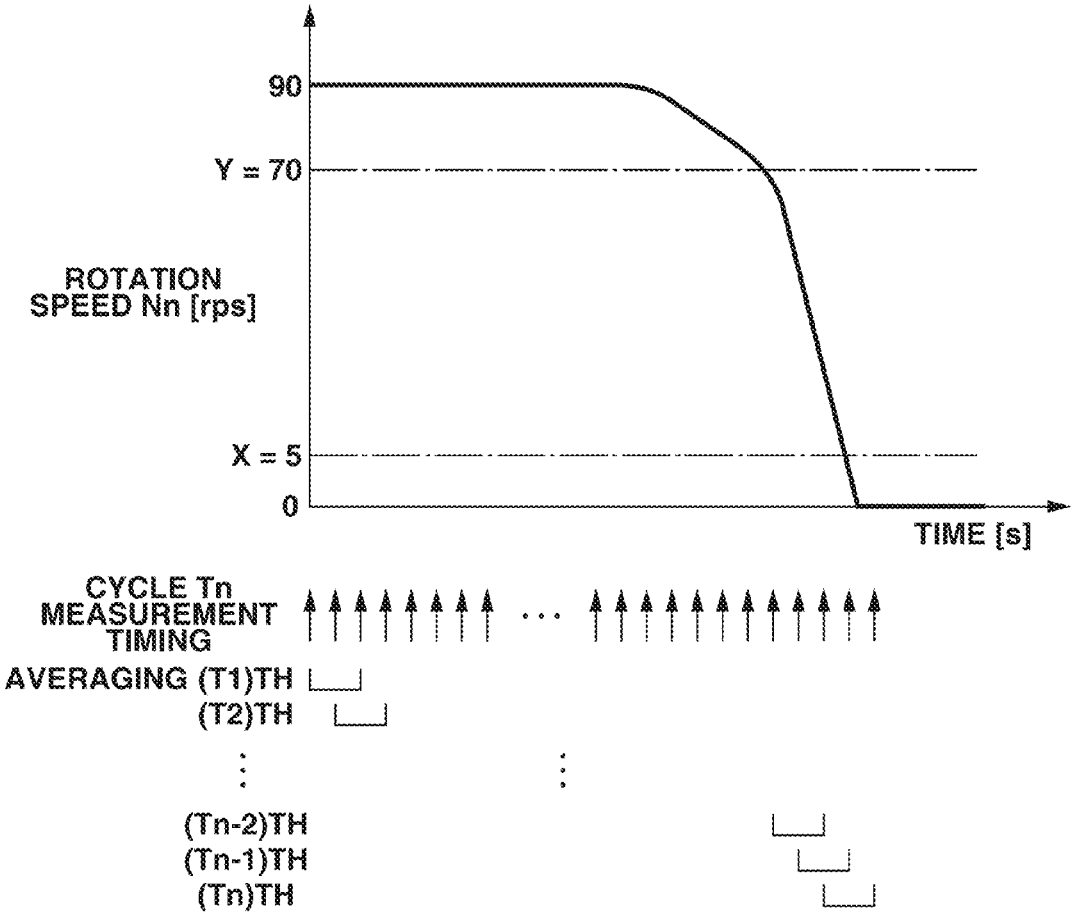
FIG. 12B is a graph illustrating measurement timing of the output torque characteristic according to the second exemplary embodiment.

In step S1707, the CPU 162 determines whether a rotation speed Nn of the motor 75 is less than or equal to a predetermined number of rotations X. The rotation speed Nn of the motor 75 is described below. The CPU 162 continuously measures the cycle of the pulse signal input from the encoder sensor 90 even in a period in which the motor 75 is driven in the forward rotation direction. FIG. 12B is a graph for describing how to determine the rotation speed Nn of the motor 75 according to the present exemplary embodiment, in which the horizontal axis indicates time [s] and the vertical axis the rotation speed Nn [rps] of the motor 75. The graph illustrated in FIG. 12B is similar to the waveform (e) of FIG. 11 in a period from when a predetermined time has elapsed after the measurement time T2, to when a predetermined time has elapsed after a BRAKE signal is output from the CPU 162 to the driving circuit 82. The rotation speed Nn refers to the rotation speed of the motor 75 in the period. As illustrated in FIG. 12B, the CPU 162 measures the cycle of the pulse signal input from the encoder sensor 90 a plurality of times. In the present exemplary embodiment, the CPU 162 continuously measures the cycle of the pulse signal three times and constantly averages the results of the three continuous measurements. In FIG. 12B, the timing at which the CPU 162 measures the cycle of the pulse signal input from the encoder sensor 90 (cycle Tn measurement timing) is indicated by the arrows. FIG. 12B illustrates that a (T1)th measurement is continuously performed three times. The same holds for (T2)th, . . . , (Tn−2)th, (Tn−1)th, and (Tn)th measurements.

The CPU 162 calculates an average value Tn of the cycle from the cycles of the pulse signal thus continuously measured three times for the (Tn)th measurement. The CPU 162 then converts the average value Tn of the cycle of the pulse signal continuously measured three times into the rotation speed Nn by using equation (7):

$$Nn=(1\div Tn)\div 18 \tag{7}$$

The rotation speed Nn is in units of [rps], and the average value in units of Tn [sec]. The numerical value 18 of equation (7) is the number of slits formed in the disk on the output shaft of the motor 75.

In such a manner, the CPU 162 constantly calculates the rotation speed Nn of the motor 75. The calculated rotation speed Nn is compared with the predetermined number of rotations X stored in the ROM 167 as needed. The predetermined number of rotations X is a value determined in consideration of the rotation speed characteristics of the motor 75, the environment where the stapleless binding device 52 is installed, and the use time and use frequency of the stapleless binding device 52. For example, in the present exemplary embodiment, X=5 [rps] (see the waveform (e) of FIG. 11). In step S1707, if the CPU 162 determines that the calculated rotation speed Nn of the motor 75 is less than or equal to the predetermined number of rotations X (YES in step S1707), the CPU 162 determines that it is the timing when the stapleless binding processing is completed. The timing when the stapleless binding processing is completed refers to the timing in which the sheet bundle S is sandwiched between the upper teeth 97 and the lower teeth 98, and the binding processing is completed on the sheet bundle S by the application of pressing force from the upper teeth 97 and the lower teeth 98 (see the state (a) of FIG. 11). When the rotation speed Nn of the motor 75 falls to or below the predetermined number of rotations X, the CPU 162 determines that the binding processing is completed. The processing then proceeds to step S1710. In such a manner, the CPU 162 determines that the stapleless binding processing is completed if a predetermined time has elapsed from the start of driving of the motor 75 and the rotation speed of the motor 75 detected by the encoder sensor 90 falls to or below a predetermined rotation speed.

In step S1707, if the CPU 162 determines that the calculated rotation speed Nn of the motor 75 is not less than or equal to the predetermined number of rotations X (NO in step S1707), the processing proceeds to step S1708. In step S1708, the CPU 162 refers to the timer started in step S1701 to determine whether a predetermined time has elapsed. The predetermined time is set at time exceeding the time needed for the binding processing. In step S1708, if the CPU 162 determines that the predetermined time has not elapsed (NO in step S1708), the processing returns to step S1707. In step S1708, if the CPU 162 determines that the predetermined time has elapsed (YES in step S1708), then in step S1709, the CPU 162 transmits a time-out error to the CPU 161 in the image forming apparatus 1 because it is likely that the motor 75 is not normally driven. In step S1713, the CPU 162 stops the motor 75. In such a manner, the CPU 162 stops driving the motor 75 if the rotation speed of the motor 75 detected by the encoder sensor 90 is still greater than the predetermined rotation speed even after a lapse of the predetermined time.

In step S1710, the CPU 162 outputs the motor driving signal to the driving circuit 82 to brake the motor 75 via the driving circuit 82 and stop the forward rotation of the motor 75. Details of step S1710 are similar to those of step S710 in FIG. 5. In step S1711, the CPU 162 outputs the motor driving signal to the driving circuit 82. Step S1711 is similar to step S711 of FIG. 5. In step S1712, the CPU 162 determines whether the ON signal is input from the reference sensor 76. If the CPU 162 determines that the ON signal is not input from the reference sensor 76 (NO in step S1712), the processing returns to step S1712. In step S1712, if the CPU 162 determines that the ON signal is input from the reference sensor 76 (YES in step S1712), then in step S1713, the CPU 162 outputs the motor driving signal to the driving circuit 82 to stop driving the motor 75 via the driving circuit 82, and ends the stapleless binding processing.

In the second exemplary embodiment, the CPU 162 constantly measures the rotation speed Nn of the motor 75. The CPU 162 determines the timing at which the rotation speed Nn falls to or below the predetermined number of rotations X to be the timing when the binding processing is completed. The timing when a certain pressing force is applied to the sheet bundle S can thus be detected regardless of the number of sheets or paper type of the sheet bundle S. The timing when the certain pressing force is applied to the sheet bundle S in the binding processing can thus be accurately detected regardless of the number of sheets or paper type of the sheet bundle S.

OTHER EXEMPLARY EMBODIMENTS

In the foregoing first exemplary embodiment, the driving current I of the motor 75 is set at the current limitation value A1 when starting driving the motor 75. The driving current I of the motor 75 is set at the limit current value IL during the binding processing. However, the configuration of the foregoing first exemplary embodiment may be applied to a case where the motor 75 is driven by a driving current I different from the limit current value IL (for example, a driving current having a current value IC) in a period other than when the motor 75 starts to be driven or during the binding processing. In such a case, the driving current IC of the motor 75 is controlled to or below the current limitation value A1.

The foregoing exemplary embodiments are configured to determine the torque constant Kt which is the output torque characteristic of the motor 75, each time the stapleless binding processing is performed on a sheet bundle S. However, similar effects to the foregoing exemplary embodiments can be obtained by performing the measurement of the rotation speed, the driving voltage V, and the driving current I, and by determining the torque constant Kt at any of the following timings. Examples include the following configurations:

The torque constant Kt is determined each time the stapleless binding processing is performed on a predetermined number of copies.

The torque constant Kt is determined by driving the motor 75 in a state where a sheet bundle S is not present in the sheet processing apparatus 50 immediately after the sheet processing apparatus 50 or the image forming apparatus 1 is powered on.

The torque constant Kt is determined only when the stapleless binding processing is performed on a predetermined-numbered copy immediately after power-on, for example, when the stapleless binding processing is performed on the first copy of a sheet bundle S.

The torque constant Kt is determined by driving the motor 75 in a state where a sheet bundle S is not present, in an operation other than the stapleless binding processing of the image forming apparatus 1 and the sheet processing apparatus 50.

In the foregoing exemplary embodiments, the torque constant Kt of the motor 75 is determined based on the rotation speed of the motor 75 and the driving voltage V of the motor 75. However, for example, the CPU 162 may detect the driving current I of the motor 75 and determine the torque constant Kt based on the rotation speed, the driving voltage V, and the driving current I of the motor 75.

The foregoing exemplary embodiments have been described by using the sheet processing apparatus 50 installed inside the image forming apparatus 1 as an example. However, exemplary embodiments are not limited to the sheet processing apparatus 50 of such a configuration. For example, the configurations of the foregoing exemplary embodiments may be applied to the stapleless binding device 52 itself or a sheet processing apparatus that is arranged beside an image forming apparatus and is used independently of the image forming apparatus. While the foregoing exemplary embodiments have been described by using the sheet processing apparatus 50 as an example, these exemplary embodiments are not limited to a sheet processing apparatus and may be applied to an image forming apparatus that itself includes a binding unit. While the foregoing exemplary embodiments have been described by using the stapleless binding device 52 as an example, exemplary embodiments are not limited to a stapleless binding device and may be applied to other sheet binding devices or mechanisms for applying constant pressure or constant torque.

In addition, the stapleless binding device 52 according to the foregoing exemplary embodiments is configured to press the tooth dies having the protrusions and recesses against the sheet bundle S by using the DC brush motor as a driving source. By providing the operation period in which little load acts on the motor 75 in the series of binding processing operations, the torque constant Kt or the output torque characteristic of the motor 75 can be detected every time. In this configuration, since the characteristic of the motor 75 can be grasped immediately before the binding operation, the pressing force can be controlled to maintain a constant level regardless of not only individual variations of the motor but also variations in the temperature of the surroundings where the stapleless binding device 52 is installed and variations in the output torque due to use time and use frequency.

A control according to an exemplary embodiment for determining the torque constant Kt of the motor 75 may be applied to, for example, a half-punched binding method for making a notch in a plurality of sheets P of a sheet bundle S. Such control may also be applied to a binding method using a binding member such as ordinary staples. In other words, the control may be applied to any binding method that uses a motor for binding processing. The control may further be applied to control of a motor when performing punching processing for making a punch hole in a sheet bundle S.

As has been described above, according to the present exemplary embodiments, the quality of the binding processing can be improved to improve the productivity of the binding processing.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application 2014-010447 filed Jan. 23, 2014, No. 2014-010448 filed Jan. 23, 2014, No. 2015-003137 filed Jan. 9, 2015, and No. 2015-003138 filed Jan. 9, 2015, which are hereby incorporated by reference herein in their entirety.

What is claimed is:

1. A sheet processing apparatus comprising:

a binding unit configured to perform binding processing by pressing a sheet bundle;

a motor configured to drive the binding unit to press the sheet bundle;

a motor controller configured to set a driving current of the motor and an upper limit value of the driving current, the motor controller being configured to set the driving current when starting activating the motor in a state where the binding unit is not pressing the sheet bundle at a first value, and set the upper limit value of the driving current in a period in which the binding unit is pressing the sheet bundle to a second value less than or equal to the first value;

a speed detector configured to detect a speed of the motor; and a voltage detector configured to detect a driving voltage of the motor, wherein the motor controller is configured to determine the upper limit value of the driving current of the motor based on the speed detected by the speed detector and the driving voltage detected by the voltage detector in a period in which the motor is being driven and the binding unit is not pressing the sheet bundle, and if the determined upper limit value is less than or equal to the first value, set the determined upper limit value as the second value.

2. The sheet processing apparatus according to claim 1, wherein the motor controller is configured to determine a torque constant of the motor based on the speed detected by the speed detector and the driving voltage detected by the voltage detector, and determine the upper limit value of the driving current of the motor based on the determined torque constant.

3. The sheet processing apparatus according to claim 1, wherein the motor controller is configured to, if the determined upper limit value is greater than the first value, determine that the motor is in an abnormal state.

4. The sheet processing apparatus according to claim 3, wherein the motor controller is configured to, if the determined upper limit value is greater than the first value, prohibit the binding unit from being driven.

5. The sheet processing apparatus according to claim 1, wherein the binding unit includes a first pressing unit configured to press one surface of the sheet bundle and a second pressing unit configured to press another surface of the sheet bundle, the second pressing unit being arranged to be opposed to the first pressing unit, and wherein the binding unit is configured to perform the binding processing by pressing the sheet bundle between the first pressing unit and the second pressing unit.

6. The sheet processing apparatus according to claim 5, wherein the binding unit is configured to bind the sheet bundle by entangling fibers of sheets of the sheet bundle with each other.

7. A sheet processing apparatus comprising:

a binding unit configured to perform binding processing by pressing a sheet bundle:

a motor configured to drive the binding unit to press the sheet bundle; and a motor controller configured to set a driving current of the motor and an upper limit value of the driving current, the motor controller being configured to set the driving current when starting activating the motor in a state where the binding unit is not pressing the sheet bundle at a first value, and set the upper limit value of the driving current in a period in which the binding unit is pressing the sheet bundle to a second value less than or equal to the first value;

wherein the motor controller is configured to set a value less than or equal to a driving current according to a maximum torque that the motor can output as the first value.

8. The sheet processing apparatus according to claim 7, wherein the binding unit includes a first pressing unit configured to press one surface of the sheet bundle and a second pressing unit configured to press another surface of the sheet bundle, the second pressing unit being arranged to be opposed to the first pressing unit, and wherein the binding unit is configured to perform the binding processing by pressing the sheet bundle between the first pressing unit and the second pressing unit.

9. The sheet processing apparatus according to claim 8, wherein the binding unit is configured to bind the sheet bundle by entangling fibers of sheets of the sheet bundle with each other.

10. A sheet processing apparatus comprising:

a binding unit configured to perform binding processing by pressing a sheet bundle;

a motor configured to drive the binding unit to press the sheet bundle;

a motor controller configured to set a driving current of the motor and an upper limit value of the driving current, the motor controller being configured to set the driving current when starting activating the motor in a state where the binding unit is not pressing the sheet bundle at a first value, and set the upper limit value of the driving current in a period in which the binding unit is pressing the sheet bundle to a second value less than or equal to the first value; and a current detector configured to detect the driving current of the motor, wherein the motor controller is configured to, if the driving current detected by the current detector reaches the second value in a period in which the binding unit is pressing the sheet bundle, brake the motor.

11. The sheet processing apparatus according to claim 10, wherein the binding unit includes a first pressing unit configured to press one surface of the sheet bundle and a second pressing unit configured to press another surface of the sheet bundle, the second pressing unit being arranged to be opposed to the first pressing unit, and wherein the binding unit is configured to perform the binding processing by pressing the sheet bundle between the first pressing unit and the second pressing unit.

12. The sheet processing apparatus according to claim 11, wherein the binding unit is configured to bind the sheet bundle by entangling fibers of sheets of the sheet bundle with each other.

13. An image forming apparatus comprising:

an image forming unit configured to form an image on a sheet;

a stacking unit for stacking sheets on which the image is formed by image forming unit;

a binding unit configured to perform binding processing by pressing a sheet bundle including a plurality of sheets stacked on the stacking unit;

a motor configured to drive the binding unit to press the sheet bundle;

a motor controller configured to set a driving current of the motor and an upper limit value of the driving current, the motor controller being configured to set the driving current when starting activating the motor in a state where the binding unit is not pressing the sheet bundle, to a first value, and set the upper limit value of the driving current in a period in which the binding unit is pressing the sheet bundle to a second value less than or equal to the first value;

a speed detector configured to detect a speed of the motor; and a voltage detector configured to detect a driving voltage of the motor, wherein the motor controller is configured to determine the upper limit value of the driving current of the motor based on the speed detected by the speed detector and the driving voltage detected by the voltage detector in a period in which the motor is being driven and the binding unit is not pressing the sheet bundle, and if the determined upper limit value is less than or equal to the first value, set the determined upper limit value as the second value.

14. The sheet processing apparatus according to claim 13, wherein the motor controller is configured to determine a torque constant of the motor based on the speed detected by the speed detector and the driving voltage detected by the voltage detector, and determine the upper limit value of the driving current of the motor based on the determined torque constant.

15. The sheet processing apparatus according to claim 13, wherein the motor controller is configured to, if the determined upper limit value is greater than the first value, determine that the motor is in an abnormal state.

16. The sheet processing apparatus according to claim 15, wherein the motor controller is configured to, if the determined upper limit value is greater than the first value, prohibit the binding unit from being driven.

17. The sheet processing apparatus according to claim 13, wherein the binding unit includes a first pressing unit configured to press one surface of the sheet bundle and a second pressing unit configured to press another surface of the sheet bundle, the second pressing unit being arranged to be opposed to the first pressing unit, and wherein the binding unit is configured to perform the binding processing by pressing the sheet bundle between the first pressing unit and the second pressing unit.

18. The sheet processing apparatus according to claim 17, wherein the binding unit is configured to bind the sheet bundle by entangling fibers of sheets of the sheet bundle with each other.

19. A sheet processing apparatus comprising:

a binding unit configured to perform binding processing by pressing a sheet bundle;

a motor configured to drive the binding unit to press the sheet bundle;

a speed detection unit configured to detect a speed of the motor; and a motor control unit configured to, if the speed detected by the speed detection unit is less than or equal to a predetermined speed in a period in which the binding unit is pressing the sheet bundle, brake the motor.

20. The sheet processing apparatus according to claim 19, wherein the motor control unit is configured to, if the speed detected by the speed detection unit is greater than the predetermined speed in the period in which the binding unit is pressing the sheet bundle and after time needed for the binding processing has lapsed, stop driving the motor.

21. The sheet processing apparatus according to claim 19, wherein the motor control unit is configured to, if the speed detected by the speed detection unit is less than or equal to a second predetermined speed faster than the predetermined speed in a period in which the motor is being driven and the binding unit is not pressing the sheet bundle, stop driving the motor.

22. The sheet processing apparatus according to claim 19, wherein the motor control unit is configured to, after the motor is braked, drive the motor so that the motor rotates in reverse.

23. The sheet processing apparatus according to claim 19, wherein the binding unit includes a first pressing unit configured to press one surface of the sheet bundle and a second pressing unit configured to press the other surface of the sheet bundle, the second pressing unit being arranged to be opposed to the first pressing unit, and wherein the binding unit is configured to perform the binding processing by pressing the sheet bundle between the first pressing unit and the second pressing unit.

24. The sheet processing apparatus according to claim 23, wherein the binding unit is configured to bind the sheet bundle by entangling fibers of sheets of the sheet bundle with each other.

25. An image forming apparatus comprising:

an image forming unit configured to form an image on a sheet;

a stacking unit for stacking sheets on which the image is formed by the image forming unit;

a binding unit configured to perform binding processing by pressing a sheet bundle including a plurality of sheets stacked on the stacking unit;

a motor configured to drive the binding unit to press the sheet bundle;

a speed detection unit configured to detect a speed of the motor; and a motor control unit configured to, if the speed detected by the speed detection unit is less than or equal to a predetermined speed in a period in which the binding unit is pressing the sheet bundle, brake the motor.

* * * * *